US011209157B2

(12) United States Patent
Frazier et al.

(10) Patent No.: US 11,209,157 B2
(45) Date of Patent: Dec. 28, 2021

(54) MODULAR HEAT RECOVERY STEAM GENERATOR SYSTEM FOR RAPID INSTALLATION

(71) Applicant: The Cleaver-Brooks Company, Inc., Thomasville, GA (US)

(72) Inventors: Randall R. Frazier, Lincoln, NE (US); Greg R. Kaup, Lincoln, NE (US); Meenatchinathan Vasudevan, Lincoln, NE (US)

(73) Assignee: The Clever-Brooks Company, Inc., Thomasville, GA (US)

( * ) Notice: Subject to any disclaimer, the term of this patent is extended or adjusted under 35 U.S.C. 154(b) by 262 days.

(21) Appl. No.: 16/047,851

(22) Filed: Jul. 27, 2018

(65) Prior Publication Data

US 2020/0032995 A1 Jan. 30, 2020

(51) Int. Cl.

| | |
|---|---|
| ***F22B 1/18*** | (2006.01) |
| ***F22B 37/00*** | (2006.01) |
| ***F22B 37/10*** | (2006.01) |
| ***F22B 37/12*** | (2006.01) |

(52) U.S. Cl.

CPC ..... *F22B 1/1815* (2013.01); *F22B 1/1892* (2013.01); *F22B 37/001* (2013.01); *F22B 37/104* (2013.01); *F22B 37/12* (2013.01)

(58) Field of Classification Search

CPC ..... F22B 37/104; F22B 37/12; F22B 37/001; F22B 37/24; F22B 1/1892; F22B 1/124; F22B 33/10; F22B 1/1815

See application file for complete search history.

(56) References Cited

U.S. PATENT DOCUMENTS

| | | | | |
|---|---|---|---|---|
| 2,654,352 A | | 10/1953 | Schoenfeld | |
| 3,440,324 A | | 5/1969 | Clay et al. | |
| 3,465,726 A | * | 9/1969 | Gerst | F22B 33/00 122/1 R |
| 3,644,978 A | | 2/1972 | Sullivan et al. | |
| 4,026,419 A | | 5/1977 | Santucci | |

(Continued)

FOREIGN PATENT DOCUMENTS

WO 2015/075537 A2 5/2015

OTHER PUBLICATIONS

Alasdair McEwen, Turnkey Installation of Two Byworth YSX6000 Steam Boilers, Apr. 15, 2014, https://www.mcbo.co.uk/blog/81-turnkey-installation-of-two-byworth-ysx6000-steam-boilers.*

*Primary Examiner* — Steven S Anderson, II
(74) *Attorney, Agent, or Firm* — SmithAmundsen LLC

(57) ABSTRACT

A modular heat recovery steam generator (mHRSG) comprises a first boiler module comprising a plurality of pipes having at least one pipe with a flanged end; a first piping deck comprising a plurality of pipes having at least one pipe with a flanged end, wherein the pipe with the flanged end is secured to the pipe with the flanged end of the first boiler module using bolts; a second boiler module comprising a plurality of pipes having at least one pipe with a flanged end; a second piping deck comprising a plurality of pipes having at least one pipe with a flanged end, wherein the pipe with the flanged end is secured to the pipe with the flanged end of the second boiler module using bolts; and a main stack. The first boiler module is operatively coupled to the second boiler module and the second boiler module is operatively coupled to the main stack.

12 Claims, 22 Drawing Sheets

(56) References Cited

U.S. PATENT DOCUMENTS

| | | | | |
|---|---|---|---|---|
| 4,466,241 | A | 8/1984 | Inui et al. | |
| 4,561,372 | A | 12/1985 | Franz et al. | |
| 4,685,426 | A | 8/1987 | Kidaloski et al. | |
| 5,339,891 | A | 8/1994 | Kidaloski et al. | |
| 5,370,239 | A | 12/1994 | Kidaloski et al. | |
| RE36,524 | E | 1/2000 | Tomlinson | |
| 6,055,803 | A | 5/2000 | Mastronarde | |
| 6,092,490 | A | 7/2000 | Bairley et al. | |
| 7,243,618 | B2 | 7/2007 | Gurevich | |
| 7,275,503 | B2 | 10/2007 | Waseda et al. | |
| 7,357,100 | B2 | 4/2008 | Waseda et al. | |
| 7,770,544 | B2 * | 8/2010 | Viskup, Jr. | F22B 1/1815 122/235.19 |
| 8,191,257 | B2 | 6/2012 | Reiner et al. | |
| 8,281,752 | B2 * | 10/2012 | English | F22B 21/16 122/235.11 |
| 8,708,035 | B2 | 4/2014 | Bruckmann et al. | |
| 9,097,418 | B2 | 8/2015 | Rancruel et al. | |
| 9,696,029 | B2 | 7/2017 | Boecker | |
| 9,739,475 | B2 | 8/2017 | Magee et al. | |
| 9,739,478 | B2 | 8/2017 | Rancruel et al. | |
| 9,828,884 | B2 * | 11/2017 | Noonan | F22B 1/1815 |
| 9,921,001 | B2 | 3/2018 | Jackson | |
| 9,995,170 | B2 | 6/2018 | Magee et al. | |
| 2006/0144348 | A1 * | 7/2006 | Viskup, Jr. | F22B 1/1815 122/235.15 |
| 2006/0175040 | A1 | 8/2006 | Waseda et al. | |
| 2011/0048010 | A1 | 3/2011 | Balcezak et al. | |
| 2014/0116361 | A1 | 5/2014 | Williams | |
| 2015/0226420 | A1 | 8/2015 | Bunce et al. | |
| 2017/0130953 | A1 | 5/2017 | Barker et al. | |
| 2017/0175998 | A1 | 6/2017 | Torkildson et al. | |

* cited by examiner

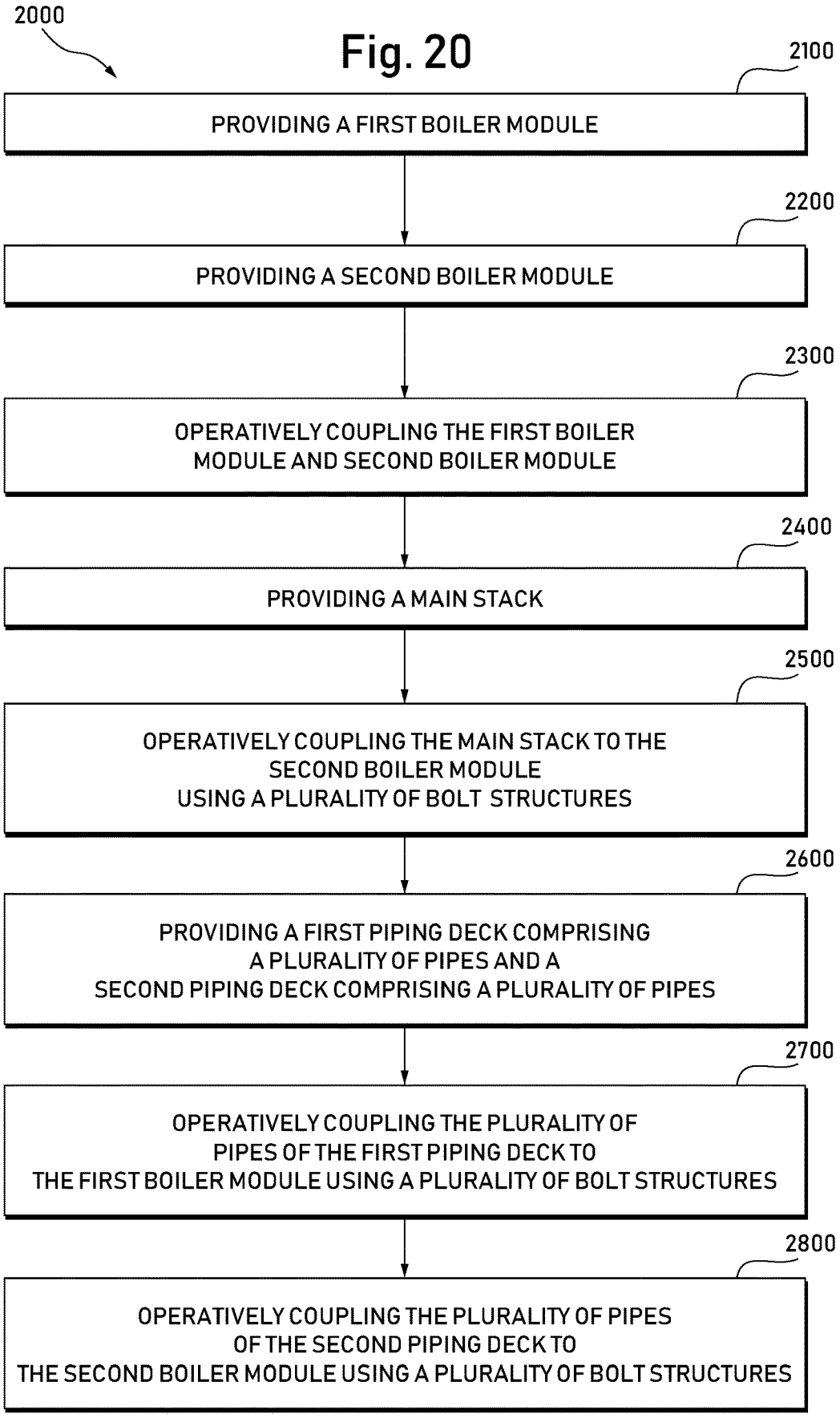
2000
Fig. 20
2100
PROVIDING A FIRST BOILER MODULE
2200
PROVIDING A SECOND BOILER MODULE
2300
OPERATIVELY COUPLING THE FIRST BOILER MODULE AND SECOND BOILER MODULE
2400
PROVIDING A MAIN STACK
2500
OPERATIVELY COUPLING THE MAIN STACK TO THE SECOND BOILER MODULE USING A PLURALITY OF BOLT STRUCTURES
2600
PROVIDING A FIRST PIPING DECK COMPRISING A PLURALITY OF PIPES AND A SECOND PIPING DECK COMPRISING A PLURALITY OF PIPES
2700
OPERATIVELY COUPLING THE PLURALITY OF PIPES OF THE FIRST PIPING DECK TO THE FIRST BOILER MODULE USING A PLURALITY OF BOLT STRUCTURES
2800
OPERATIVELY COUPLING THE PLURALITY OF PIPES OF THE SECOND PIPING DECK TO THE SECOND BOILER MODULE USING A PLURALITY OF BOLT STRUCTURES

MODULAR HEAT RECOVERY STEAM GENERATOR SYSTEM FOR RAPID INSTALLATION

FIELD

The present invention relates to heat recovery steam generators, and more particularly to modular heat recovery steam generators that are assembled on site, as well as associated methods.

BACKGROUND

A heat recovery steam generator (HRSG) produces steam utilizing heat which would otherwise be lost from a hot gas stream. HRSGs can operate at various pressure levels and generally have three main components per pressure level—an economizer, an evaporator, and a superheater together forming a boiler module. The number of pressure levels will determine the number and configuration of economizers, evaporators and superheaters. HRSGs are therefore modular in order to optimize the system to the specific unit being fitted with the HRSG.

Generally, the piping, valves, instrumentation, control valves, operation and maintenance platforms, vent piping, pipe hangers and pipe supports necessary to connect the main components of the HRSG, and integrate the HRSG with a desired unit, are shipped disassembled. The assembling of a HRSG requires welding and pipefitting, and the assembly process can take weeks, or even months. The time and man hours needed to configure an HRSG are significant.

In view of one or more such limitations that exist in relation to conventional HRSGs, it would be advantageous if improvements could be achieved in relation to such HRSGs and related methods. In a particular embodiment, there is a need for such an HRSG system that has parts that can be assembled, disassembled and/or reassembled more quickly and more efficiently than conventional HRSGs.

SUMMARY

The present disclosure, in at least some embodiments, relates to a modular heat recovery steam generator and associated methods.

In an embodiment, a modular heat recovery steam generator (mHRSG) is provided. The mHRSG comprises a first boiler module comprising a plurality of pipes having at least one pipe terminating in a flanged end; a first piping deck comprising a plurality of pipes having at least one pipe terminating in a flanged end, wherein the pipe terminating in a flanged end of the first piping deck is secured to the pipe terminating in a flanged end of the first boiler module using a plurality of bolts extending through the flanged ends; a second boiler module comprising a plurality of pipes having at least one pipe terminating in a flanged end; a second piping deck comprising a plurality of pipes having at least one pipe terminating in a flanged end, wherein the pipe terminating in a flanged end of the second piping deck is secured to the pipe terminating in a flanged end of the second boiler module using a plurality of bolts extending through the flanged ends; and a main stack, wherein the first boiler module is operatively coupled to the second boiler module, and wherein the second boiler module is operatively coupled to the main stack.

In another embodiment, a method of assembling a modular heat recovery steam generator (mHRSG) is provided. The method comprises the steps of providing a first boiler module; providing a second boiler module; operatively coupling the first boiler module and the second boiler module providing a main stack; operatively coupling the main stack to the second boiler module using a plurality of bolt structures; providing a first piping deck comprising a plurality of pipes and a second piping deck comprising a plurality of pipes; operatively coupling the plurality of pipes of the first piping deck to the first boiler module using a plurality of bolt structures; and operatively coupling the plurality of pipes of the second piping deck to the second boiler module using a plurality of bolt structures.

Other embodiments are contemplated and considered to be within the scope of the present disclosure.

BRIEF DESCRIPTION OF THE DRAWINGS

Features of the present disclosure which are believed to be novel are set forth with particularity in the appended claims. Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings:

FIG. 20 is a flow chart depicting an exemplary method of assembling a mHRSG in accordance with embodiments of the present disclosure.

DEFINITIONS

Figure 1A:
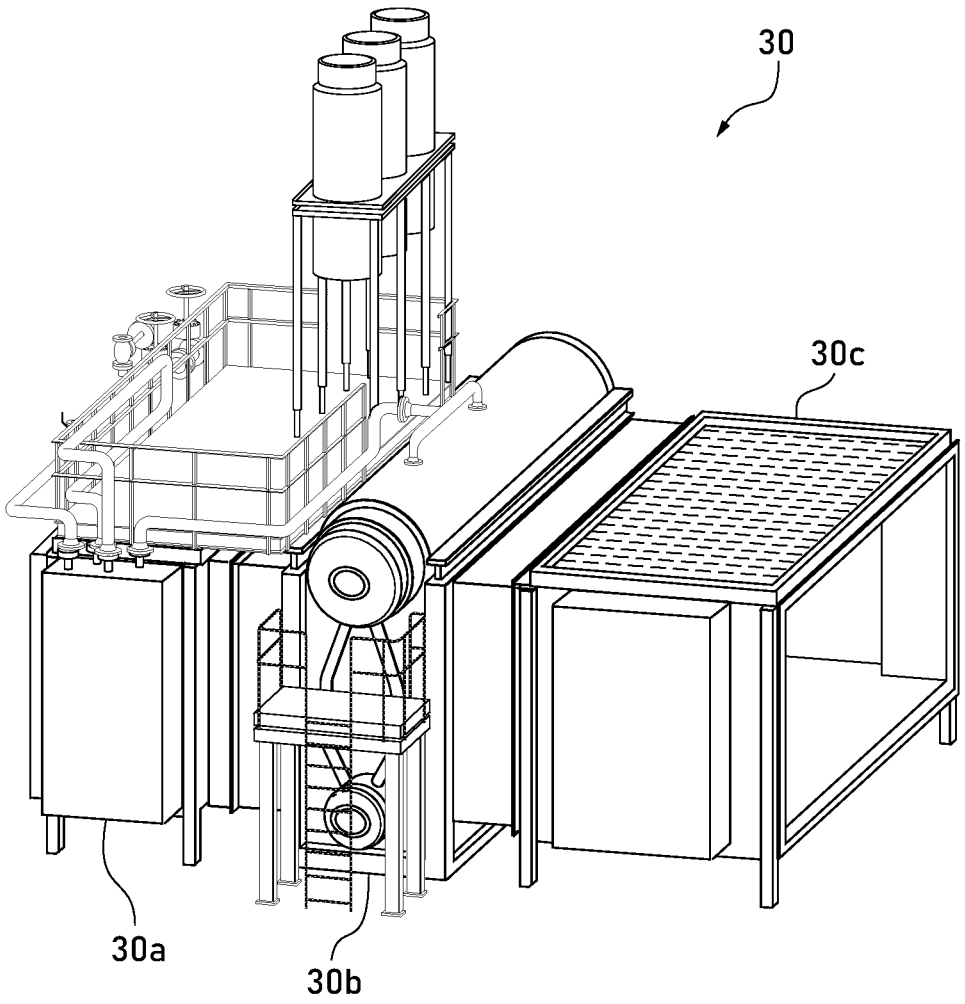
FIG. 1A is a an exemplary boiler module for a modular heat recovery steam generator.

The numerical ranges disclosed herein include all values from, and including, the lower and upper value. For ranged containing explicit values (e.g., 1 or 2; or 3 to 5; or 6; or 7), any subrange between any two explicit values is included (e.g., 1 to 2; 2 to 6; 5 to 7; 3 to 7; 5 to 6; etc.).

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional component, structure or step unless stated to the contrary. In contrast, the term, "consisting essentially of" excludes from the scope of any succeeding recitation any other component, structure or step, excepting those that are not essential to operability. The term "consisting of" excludes any component, structure or step not specifically delineated or listed. The term "or," unless stated otherwise, refers to the listed members individually as well as in any combination. Use of the singular includes use of the plural and vice versa.

The term "bolt structure" as used herein refers to a structure such as a mechanical fastener having a generally bar-, pin- or sheet-like shape used to join or fasten two structures, or portions of structures. Nonlimiting examples of bolt structures include bolts (threaded or unthreaded), screws, pins, bars, posts, clips, buckles, clamps, dowels and other similar fasteners. Bolt structures may be used alone or in combination with one or more supporting/reinforcing structures, such as washers, spacers, nuts, locks, clips, ties, pins, and other such supporting/reinforcing structures. In an embodiment, the bolt structures used in embodiments of the present disclosure are selected from the group consisting of a bolt, a retainer pin, and combinations thereof.

The term "gasket" as used herein refers to a mechanical seal positioned between two mating surfaces. Gaskets may be made of any suitable material, but are usually made of rubber. Nonlimiting examples of suitable gaskets used in the context of the present disclosure include rope gaskets, ring gaskets (e.g., o-ring gaskets), wound gaskets, flange gaskets, and solid material gaskets. In an embodiment, the gaskets used in embodiments of the present disclosure are selected from rope gaskets, flange gaskets and combinations thereof.

Unless stated to the contrary, implicit from the context, or customary in the art, all parts and percents are based on weight and all test methods are current as of the filing date of this disclosure.

Any statements provided regarding features which improve the safety of any component, structure, device, system or method described herein are not intended to guarantee, warrant or represent the safety of the components, structures, devices, systems or methods, and not guarantee, warranty or representation is made as to whether a component, structure, device, system or method meets any requirements set forth by a regulating agency and/or for any intended use.

For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

DETAILED DESCRIPTION

Heat recovery steam generators (HRSGs) are generally installed as a secondary system which recovers heat which would otherwise be lost from a primary system (such as a gas turbine) and turns that heat into steam to drive a steam turbine and ultimately used to generate electricity. HRSGs can be installed simultaneously with a primary system, for example, as part of a new plant, or as a retrofit to existing systems. In accordance with an aspect of the present disclosure, the Applicants have discovered that by utilizing a combination of bolts (or other connection mechanisms or assemblies) and pressure part modules designed to receive piping decks and other piping components, a modular HRSG (mHRSG) can be fit to an existing unit (or, for that matter, installed simultaneously with a new system) with reduced time and manpower (cost) and little to no pipe welding onsite is necessary.

In an embodiment, the present disclosure provides a mHRSG including at least one boiler module. An exemplary boiler module 30 is shown in FIG. 1. A boiler module 30 includes a superheater 30*a*, an evaporator 30*b*, and an economizer 30*c*. The components of the boiler module 30 may be provided together as a single unit or individually, or the functionality of two such components may be integrated in a single structure to increase the modularity of the mHRSG.

mHRSGs include at least one boiler module 30. In an embodiment, mHRSGs include at least two, or at least three, or up to 5-10 boiler modules, depending on the configuration of the overall system. In embodiments in which more than one boiler module is used, each boiler module runs at a different pressure. Generally, in such embodiments, the boiler modules operate at continually decreasing pressures with the highest pressure boiler module located furthest upstream and the lowest pressure boiler module located furthest downstream.

Figure 1B:
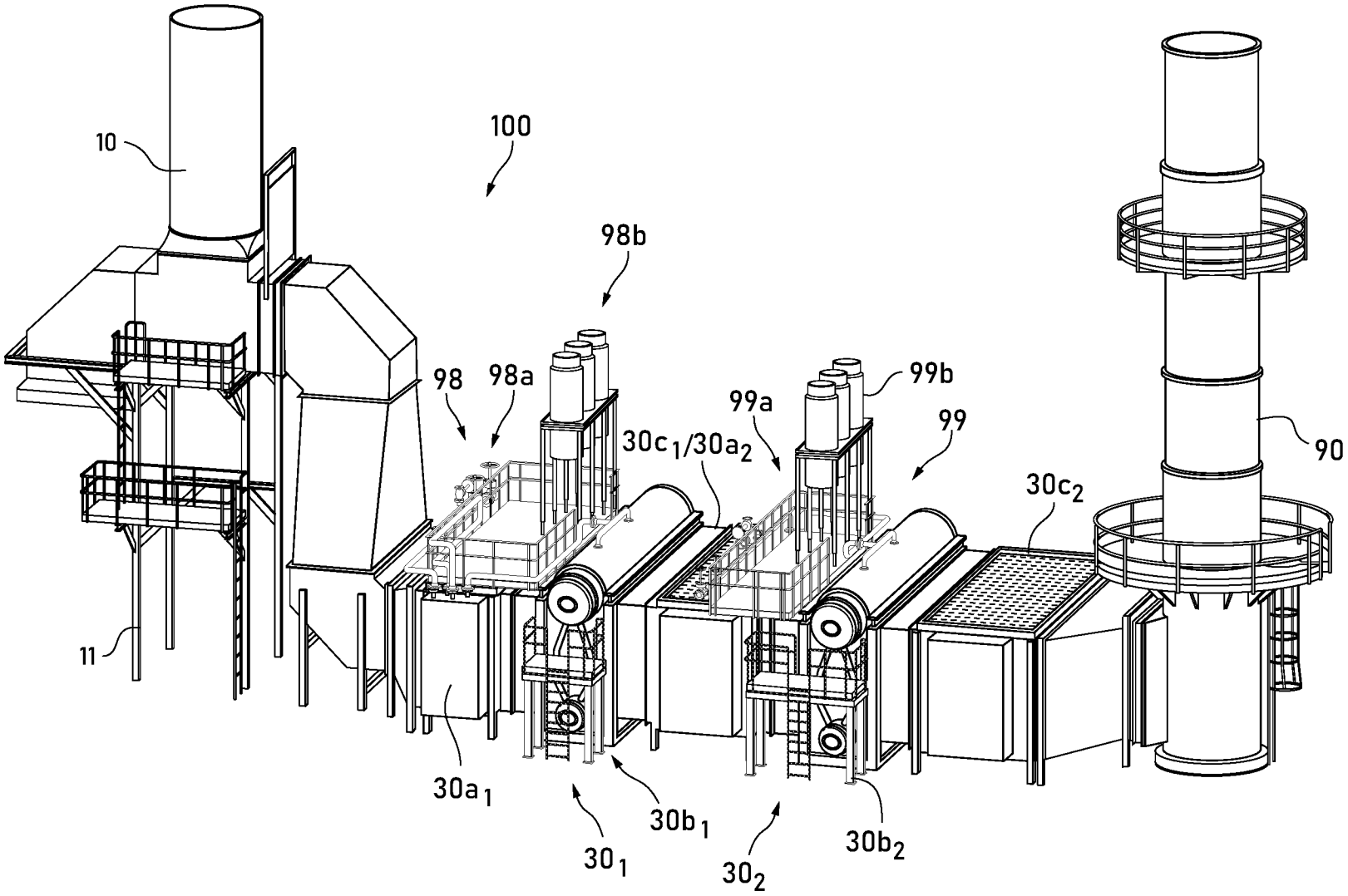
FIG. 1B is an embodiment of an exemplary modular heat recovery steam generator containing multiple boiler modules in accordance with embodiments of the present disclosure.

While a mHRSG can have a single (first) boiler module 30, including a second, third, or further additional boiler modules will increase the efficiency of the mHRSG. FIG. 1B illustrates and exemplary mHRSG 100 having a first boiler module $\mathbf{30}_1$ and a second boiler module $\mathbf{30}_2$. Each boiler module $\mathbf{30}_1$, $\mathbf{30}_2$ includes a superheater $\mathbf{30}a_1$, $\mathbf{30}a_2$, an evaporator $\mathbf{30}b_1$, $\mathbf{30}b_2$, and an economizer $\mathbf{30}c_1$, $\mathbf{30}c_2$. As shown in FIG. 1B, the economizer of the second boiler module $\mathbf{30}c_1$ and the superheater of the first boiler module $30a_2$ are integrated into a single structure $30c_1/30a_2$ having integrated economizer and superheater functionality.

In addition to the two boiler modules $30_1$, $30_2$, the embodiment shown in FIG. 1B further includes an optional bypass system 10 and a main stack 90.

The mHRSGs described herein are intended to be used in applications with a combustion gas turbine exhaust flowrate from approximately 500,000 lb/hr, or 600,000 lb/hr, or 700,000 lb/hr to 800,000 lb/hr, or 900,000 lb/hr, or 1,000,000 lb/hr. The mHRSGs described herein can be applied to either single pressure non-reheat systems or dual pressure non-reheat systems, although systems including more than two pressure levels are contemplated. In a reheat system, steam is extracted from a downstream stage and sent to a HRSG for reheat before returning to the primary system, e.g., turbine. While a mHRSG may be applied to and used in combination with a reheat system, the embodiments described herein are used in relation to a non-reheat system. In the particular embodiment shown in FIG. 1B, for example, the mHRSG 100 is applied to a dual pressure non-reheat system.

The individual components of the mHRSGs 100 will now be described in further detail.

Bypass System

In an embodiment, the mHRSG 100 includes a bypass system 10. While the mHRSG 100 of FIG. 1B is shown including a bypass system 10, it will be understood that the bypass system 10 is an optional component and is shown in FIG. 1B for completeness. A bypass system 10 diverts flue gases from the mHRSG 100 to the bypass stack 12 which prevents the flue gasses from entering the mHRSG 100. This allows the mHRSG 100 to be inspected, repaired, etc., without shutting down the primary system. The bypass system 10 also allows for greater operations control by permitting the mHRSG 100 to be bypassed and flue gasses to be diverted as needed based on power demand and cycle operation. In an embodiment, the bypass system 10 may also receive a steam pressure signal from the mHRSG 100 and permitting flue gasses to enter the bypass system 10 when steam pressure is greater than a triggering threshold value. In the current embodiment shown in mHRSG 100, the bypass system has been raised to both provide maintenance access to the gas turbine and accommodate a vertical exhaust discharge from the gas turbine.

Figure 2:
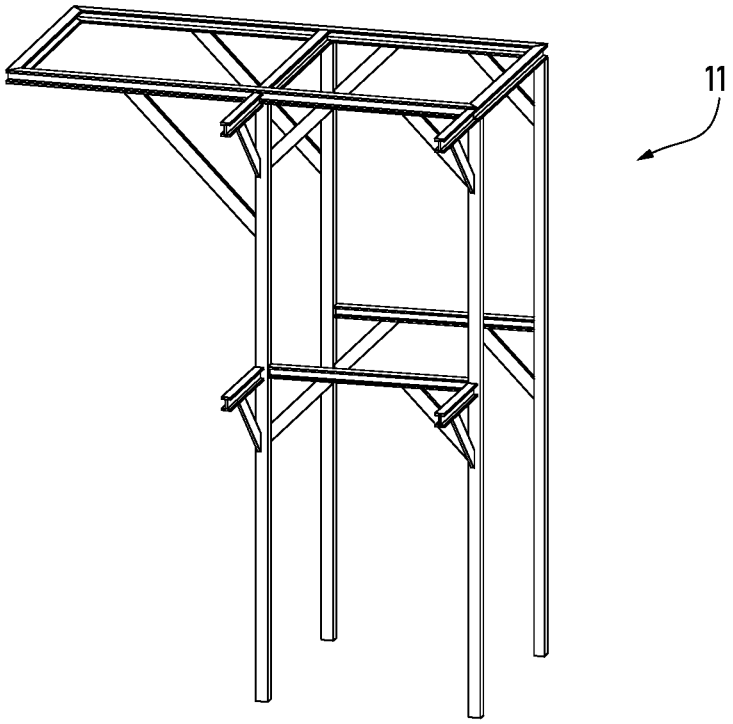
FIG. 2 is an exemplary bypass support structure in accordance with embodiments of the present disclosure.
Figure 3:
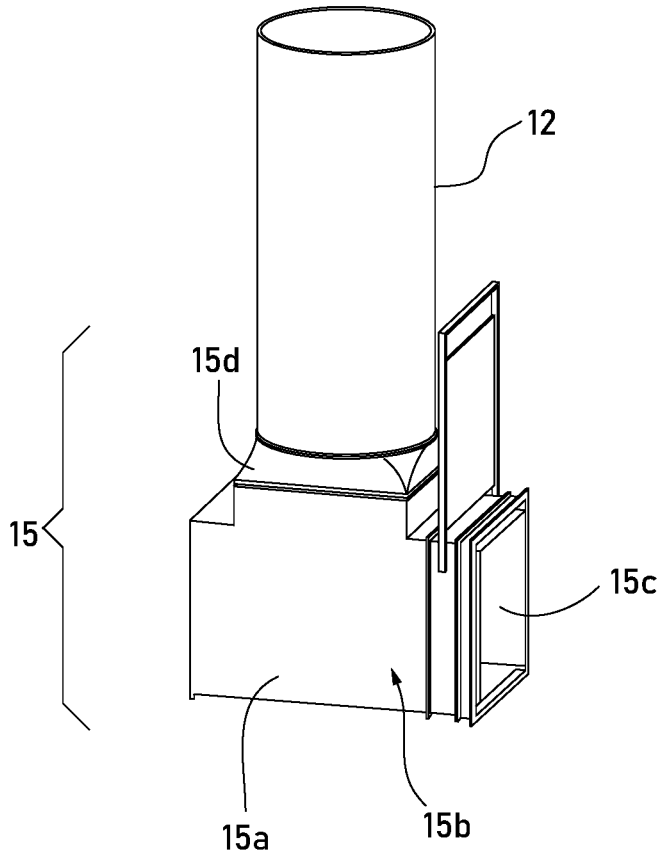
FIG. 3 is an exemplary diverter system for a bypass system in accordance with embodiments of the present disclosure.

In an embodiment, such as shown in FIGS. 2-3, the bypass system 10 includes a bypass support structure 11, a diverter system 15 (comprising a diverter 15*a*, a blanking plate 15*b*, an expansion joint 15*c*, and a bypass stack inlet transition 15*d*), and a bypass stack 12. Other components include an actuator 13 (not shown), a hoist 14 (not shown), a seal air fan skid 16 (not shown) and a junction box 17 (not shown) which in some embodiments such as shown in FIG. 3, is provided as a part of the diverter system 15.

Figure 4:
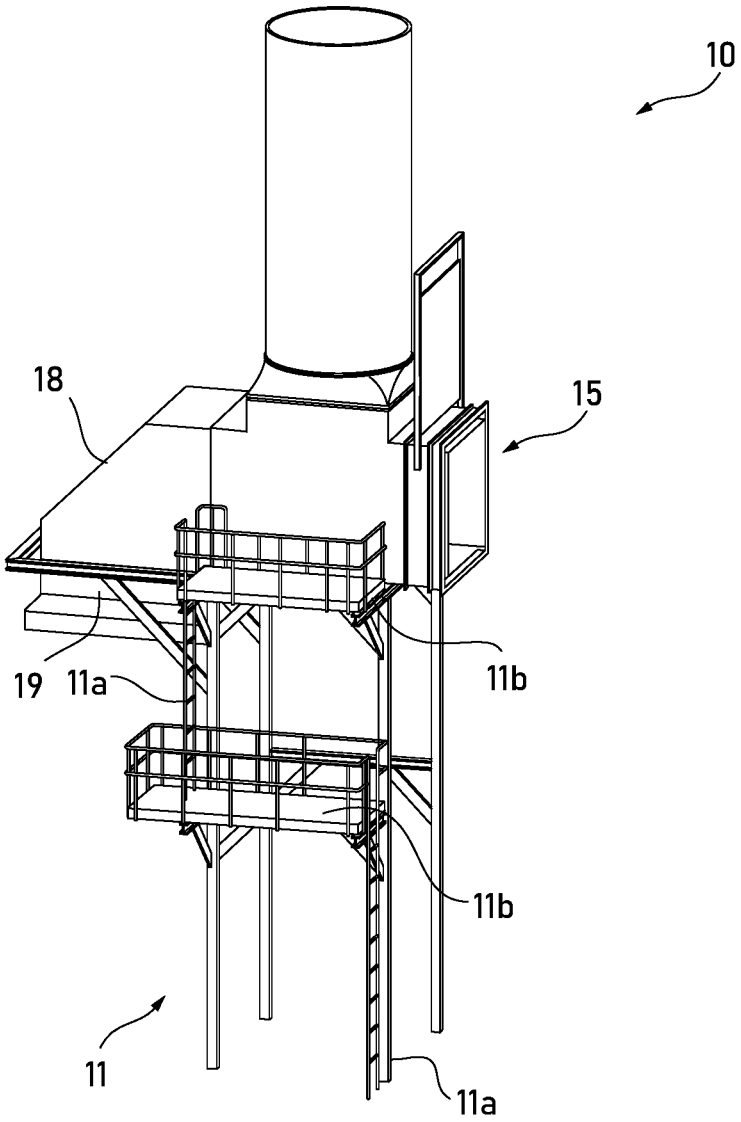
FIG. 4 shows an assembled bypass system and bypass support structure in accordance with embodiments of the present disclosure.

In an embodiment, the bypass stack 12 is connected to the diverter systems by way of the bypass stack inlet transition 15*d*. In particular, as shown in FIG. 4 the bypass stack 12 includes a flange and the bypass stack inlet transition includes a flange. A gasket is provided between the flanges and the flanges are secured together using a plurality of bolt structures. As previously described, a bolt structure refers to any form of mechanical fastener having a generally bar-, pin-, or sheet-like shape and may, in some embodiments, be used in combination with one or more supporting/reinforcing structures. In the particular embodiment shown, the bolt structure is a bolt used in combination with nuts and washers. Similarly, in the particular embodiment, the gasket may be any suitable gasket to provide a seal between the flanges. In the embodiment shown, the gasket is a rope gasket.

In a particular embodiment, the bypass support structure 11 weighs from approximately 15,000 lb, or 18,000 lb to 20,000 lb or 22,000 lb, or 25,000 lb and is made out of from approximately 15 to 30 individual pieces, including beams and brackets. In a particular embodiment, the diverter system 15 is provided as a single unit weighing from approximately 15,000 lb, or 20,000 lb, or 25,000 lb to 30,000 lb, or 35,000 lb, or 40,000 lb. In a particular embodiment, the seal air fan skid 16 is provided as a single unit and weighs from approximately 500 lb, or 750 lb, or 1,000 lb to 1,250 lb, or 1,500 lb. In a particular embodiment, the bypass stack 12 is provided as a single unit and weighs from approximately 15,000 lb, or 18,000 lb, or 20,000 lb to 22,000 lb, or 25,000 lb.

In an embodiment, the complete diverter system 15 weighs from approximately 45,000 lb, or 47,500 lb, or 50,000 lb, to 51,000 lb, or 52,000 lb, or 55,000 lb, or 58,000 lb.

As shown in FIG. 4, the bypass system 10 may also include a diverter inlet duct 18 and an inlet transition and expansion joint 19. The diverter inlet duct 18 and inlet transition and expansion joint 19 accept flue gas into the bypass system 10. The specific arrangement of these components may vary depending on the overall configuration of the mHRSG100.

In an embodiment, the inlet transition and expansion joint 19 is provided as a single unit and weighs from approximately 3,000 lb, or 4,000 lb to 5,000 lb, or 6,000 lb, or 7,000 lb. In an embodiment, the diverter inlet duct 18 is provided as a single unit and weighs from approximately 15,000 lb, or 17,000 lb, or 18,000 lb to 19,000 lb, or 20,000 lb.

In an embodiment, such as shown in FIG. 4, the bypass support structure 11 includes access structures, such as ladders 11*a* to access the various components of the bypass system 10. In a further embodiment, the bypass support structure 11 may optionally include a bypass access platform 11*b* and/or bypass rest platform 11*e* depending the specific configuration and height of the bypass access platform 11.

In an embodiment, the bypass access platform 11*b* is provided as a single unit and weighs from approximately 1,500 lb, or 1,750 lb, or 2,000 lb to 2,250 lb, or 2,500 lb, or 3,000 lb. In an embodiment, the bypass rest platform 11*e* is provided as a single unit and weighs from approximately 1,500 lb, or 1,750 lb, or 2,000 lb to 2,250 lb, or 2,500 lb, or 3,000 lb.

Boiler Modules

As described above, and with reference to FIG. 1A, the mHRSG 100 includes one or more boiler modules 30. The mHRSGs 100 of the present disclosure may include one, or two, or three, or four, or even more than four boiler modules 30. In an embodiment, the mHRSGs 100 of the present disclosure include from one to three boiler modules 30, and more preferably one or two.

As further described above with reference to FIG. 1A, each boiler module 30 includes a superheater 30*a*, an evaporator 30*b*, and an economizer 30*c*. These structures may be provided together as part of a single unit or provided separately, or the functionality of two such structures may be integrated in a single structure. In embodiments in which multiple boiler modules are provided in a single mHRSG, the economizer 30*c* of a first boiler module and the superheater 30*a* of an immediately subsequent boiler module may be provided as a single structure $30c_1/30a_2$ having the functionality of both an economizer and superheater, such as shown in FIG. 1B, for example.

In embodiments in which a mHRSG includes a structure having integrated economizer and superheater functionality $\mathbf{30}c_1/\mathbf{30}a_2$ as part of two boiler modules, such a structure $\mathbf{30}c_1/\mathbf{30}a_2$ may weigh from approximately 100,000 lb, or 125,000 lb to 150,000 lb, or 175,000 lb. Such a structure $\mathbf{30}c_1/\mathbf{30}a_2$ may further include one or more integrated expansion joint for connection to one or more evaporators of the two boiler modules.

In a further embodiment, the structure having integrated economizer and superheater functionality $\mathbf{30}c_1/\mathbf{30}a_2$ has internal linear dimensions of from approximately 10.00 ft, or 10.20 ft, or 10.40 ft to 10.42 ft, or 10.50 ft, or 10.70 ft, or 11.00 ft in height and from 26.00 ft, or 26.50 ft, or 26.70 ft, or 26.79 ft to 26.80 ft, or 27.00 ft, or 27.20 ft in width.

In an embodiment, the structure having integrated economizer and superheater functionality $\mathbf{30}c_1/\mathbf{30}a_2$ includes from approximately 130, or 140, to 149, or 150, or 160, or 175 fastening components or structures, such as, by way of nonlimiting example, retainer clips and/or welds, to secure to the evaporators of the two boiler modules.

The boiler modules 30 of the mHRSG 100 each further include a plurality of water columns 32 (not shown), drum level instrumentation 34 (not shown), drum pressure instrumentation 36 (not shown) chemical feed drain rack with pre-piped instruments 37 (not shown) and a junction box with instruments pre-wired 38 (not shown). By pre-installing these components in the shop and prior to assembling the mHRSG on site, the mHRSG can be installed on site with little to no welding necessary. While such components is part of the present embodiment, it is understood that whether such additional components are provided and, if so, the type, nature and configuration of such additional component may vary based on the configuration of the mHRSG and the primary system with which it is being used.

Figure 5:
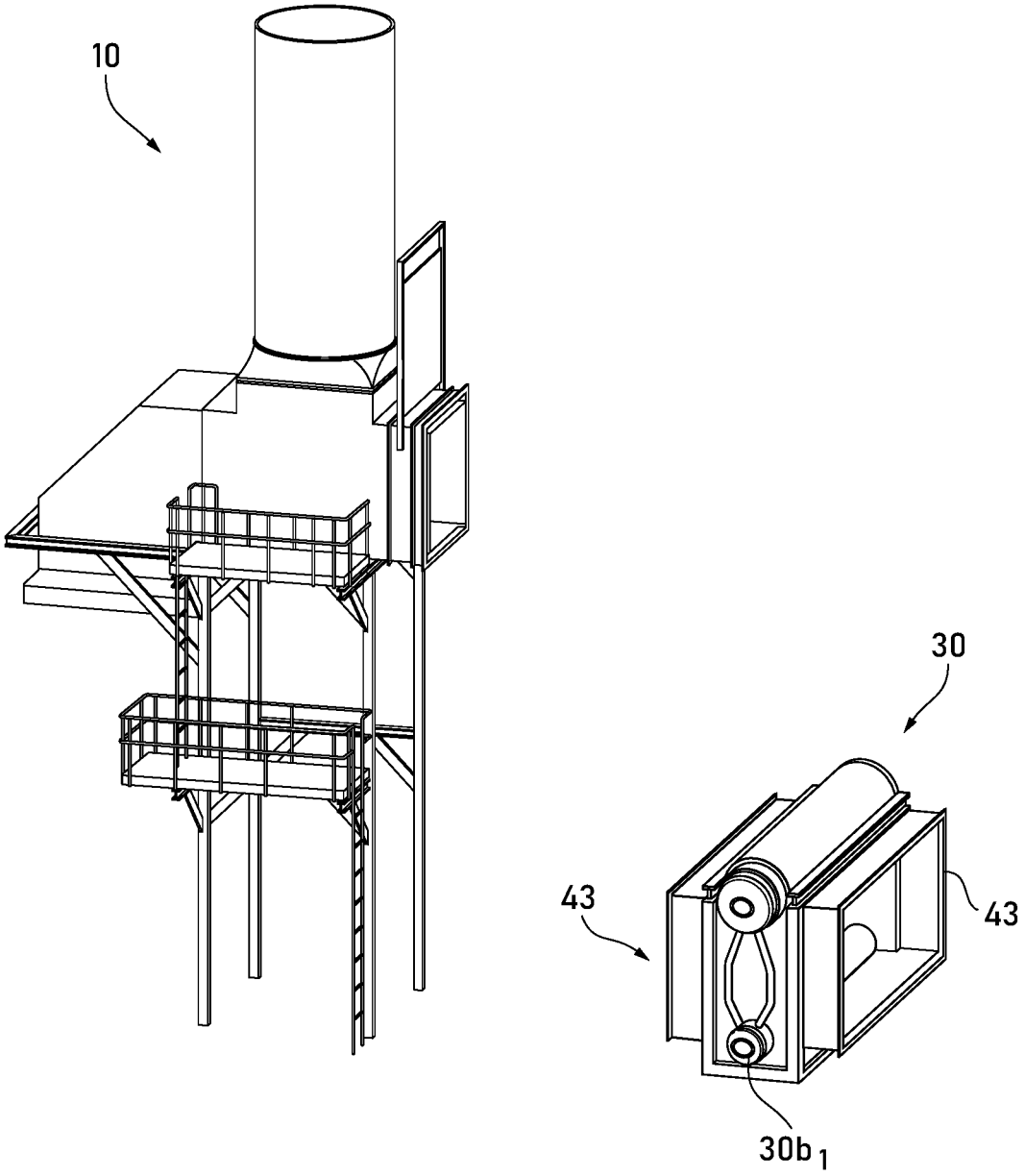
FIG. 5 is an exemplary high pressure boiler module in accordance with embodiments of the present disclosure.

Further, and as shown in FIG. 5, the boiler modules 30 and, if relevant, their individual components, of the mHRSGs include flanged connections 43 for connecting the high pressure boiler module 30 to other components of the mHRSG 100. The flanged connections 43 likewise eliminate welding and streamline the installation process.

In an embodiment in which the evaporator 30*b* of a boiler module is provided as a single unit, any such water columns, drum level instrumentation, drum pressure instrumentation, chemical feed drain racks with pre-piped instruments, junction boxes with pre-wired instruments and other such structures, which improve the functionality of the evaporator 30*b*, may be provided as part of the evaporator 30*b*. In such embodiments, the evaporator 30*b* may weigh from approximately 100,000 lb, or 150,000 lb, or 200,000 lb, or 250,000 lb to 275,000 lb, or 300,000 lb, or 325,000 lb.

The boiler modules 30 may also include piping (identified as 98*a* in the embodiment shown in FIG. 5) and a silencer rack (identified as 98*b* in the embodiment shown in FIG. 5). These components of the boiler modules 30 are provided on a piping deck (identified as 98 in the embodiment shown in FIG. 16, for example). The piping decks are assembled offsite and then connected to the upper side of a boiler module 30. The pipes having flanged ends to facilitate easy connection with the other components of the boiler module 30.

The piping decks also include any valves, supports and other components necessary to support the pipes and make the boiler module 30 functional.

While the above description of the boiler modules 30 is, in at least some parts, described with reference to figures in which multiple boiler modules 30 are used in the mHRSG 100, it will be appreciated that the description does not apply solely to the boiler module 30 shown, but rather to all boiler modules 30 used in a mHRSG 100. In view thereof, and with reference to FIGS. 1B and 2-19, the specific mHRSG 100 depicted therein including two boiler modules $\mathbf{30}_1$ and $\mathbf{30}_2$ is now described.

High Pressure Boiler Module

In the embodiment shown in FIGS. 1B and 2-19, the first boiler module $\mathbf{30}_1$ is a high pressure boiler module, meaning that the operating pressure of the first boiler module $\mathbf{30}_1$ is greater than the operating pressure of the subsequent (or, in this case, second) boiler module $\mathbf{30}_2$. The first boiler module $\mathbf{30}_1$ comprises a superheater $\mathbf{30}a_1$, an evaporator $\mathbf{30}b_1$, and an economizer $\mathbf{30}c_1$. In the embodiment shown, the superheater $\mathbf{30}a_1$ and economizer $\mathbf{30}b_1$ are provided as discrete units while the economizer $\mathbf{30}c$ is integrated with the superheater of the second boiler module $\mathbf{30}a_2$ to form a structure having integrated economizer and superheater functionality $\mathbf{30}c_1/\mathbf{30}a_2$. The structure having integrated economizer and superheater functionality $\mathbf{30}c_1/\mathbf{30}a_2$ is therefore shared between the first boiler module $\mathbf{30}_1$ and the subsequent boiler module $\mathbf{30}_2$. However, in further embodiments, the economizer $\mathbf{30}c_1$ may be provided as a standalone structure.

Further, and as shown in FIG. 5, the first boiler module $\mathbf{30}_1$, or, if relevant, its individual components, include flanged connections 43 for connecting the first boiler module $\mathbf{30}_1$ to other components of the mHRSG 100, as described above.

In the embodiment shown, the superheater $\mathbf{30}a_1$ is positioned between the bypass system 10 and the rest of the first boiler module $\mathbf{30}_1$. The superheater $\mathbf{30}a_1$ heats the steam entering the first boiler module $\mathbf{30}_1$ to the final temperature desired before entering the evaporator $\mathbf{30}b_1$. The superheater $\mathbf{30}a_1$ may be connected to the other components of the mHRSG 100, including other components of the first boiler module $\mathbf{30}_1$, by bolting flanged connections, either directly or via an expansion joint 25, such as shown, for example, in FIG. 7.

In an embodiment, the superheater $\mathbf{30}a_1$ weighs from approximately 50,000 lb, or 55,000 lb, or 60,000 lb to 65,000 lb, or 68,000 lb, or 70,000 lb. In an embodiment, the expansion joint 25 is integrated with the superheater $\mathbf{30}a_1$.

As shown in FIG. 5 the superheater $\mathbf{30}a_1$ may be connected to the evaporator $\mathbf{30}b_1$ by connecting flanges on the expansion joint 25 to flanges on the upstream side of the evaporator $\mathbf{30}b_1$ using a plurality of bolt structures. In the embodiment shown, the bolt structures are bolts used in combination with nuts and washers. A gasket may be provided between the flanges. In the embodiment shown, the gasket is a rope gasket.

In an embodiment, such as shown in FIG. 1B the economizer $\mathbf{30}c_1$ (or structure having integrated economizer and superheater functionality $\mathbf{30}c_1/\mathbf{30}a_2$) is positioned between the first boiler module $\mathbf{30}_1$ and the second boiler module $\mathbf{30}_2$. The economizer $\mathbf{30}c_1$ absorbs heat from the flue gas, thereby lowering the flue gas temperature and raising the water temperature of the first boiler module $\mathbf{30}_1$.

Figure 7:
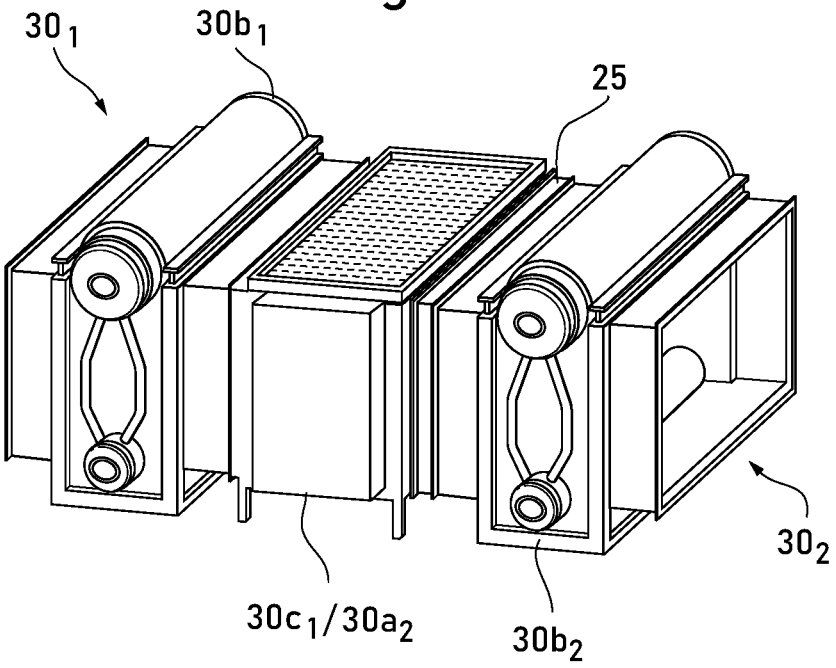
FIG. 7 shows the connection of the exemplary high pressure boiler module of FIG. 5 and the exemplary low pressure boiler module of FIG. 6 using a structure having integrated high pressure economizer and low pressure superheater functionality in accordance with embodiments of the present disclosure.

The economizer $\mathbf{30}c_1$ (or structure having integrated economizer and superheater functionality $\mathbf{30}c_1/\mathbf{30}a_2$) may be connected to the other components of the mHRSG 100 by securing flanged connections to an expansion joint, such as shown, for example, in FIG. 7. In an embodiment, the securing is completed using a plurality of bolt structures, or further, bolts alone, or in combination with additional supporting/reinforcing structures.

In the particular embodiment shown in FIG. 5, the first boiler module $\mathbf{30}_1$ further includes a plurality of water columns $\mathbf{32}_1$ (not shown), drum level instrumentation $\mathbf{34}_1$ (not shown), drum pressure instrumentation $\mathbf{36}_1$ (not shown) chemical feed drain rack with pre-piped instruments $\mathbf{37}_1$ (not shown) and a junction box with instruments pre-wired $\mathbf{38}_1$ (not shown). By pre-installing these components in the shop and prior to assembling the mHRSG on site, the mHRSG can be installed on site with little to no welding necessary.

In an embodiment, the evaporator $\mathbf{30}b_1$ is provided as a single unit including the water columns 32, (not shown) drum level instrumentation 34, (not shown), drum pressure instrumentation 36, (not shown), chemical feed drain rack with pre-piped instruments 37, (not shown) and junction box with pre-wired instruments 38, preinstalled, and weighs from approximately 200,000 lb, or 225,000 lb, or 240,000 lb to 255,000 lb, or 275,000 lb, or 300,000 lb, or 325,000 lb.

Figure 16:
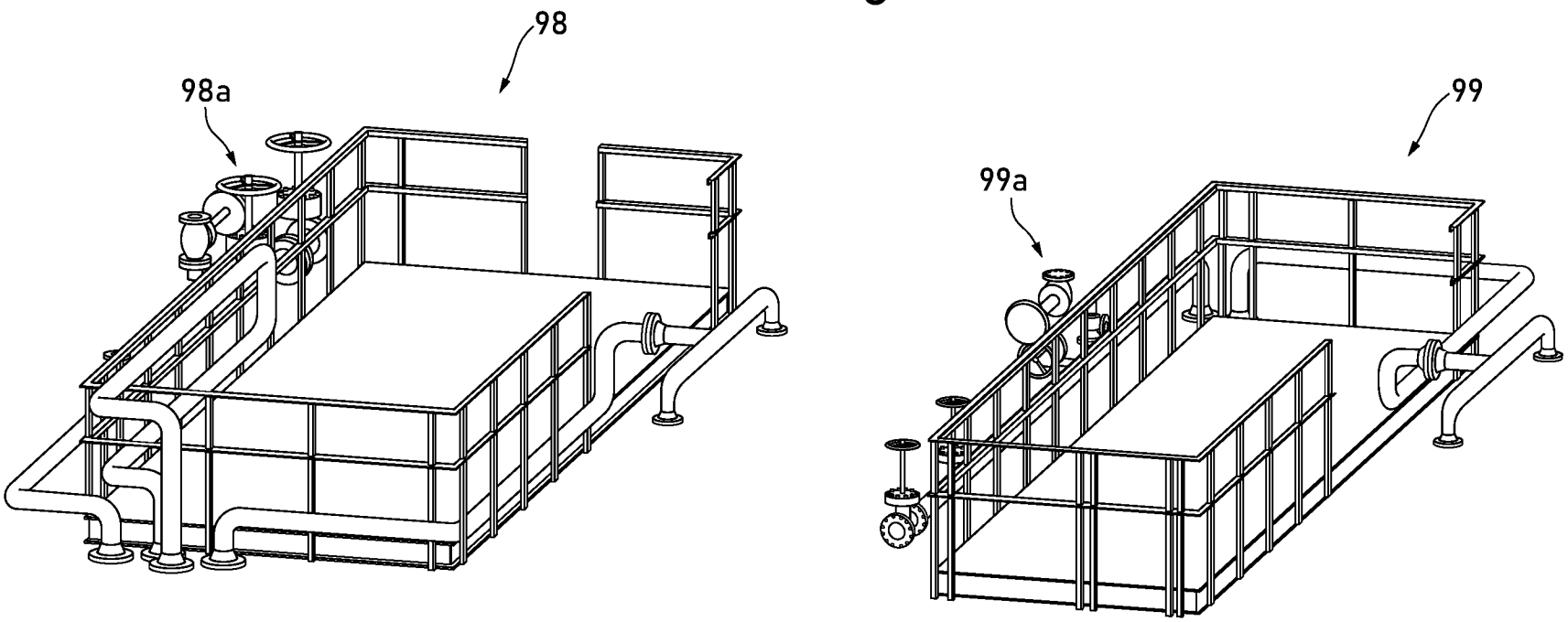
FIG. 16 is a high pressure piping deck and a low pressure piping deck in accordance with embodiments of the present disclosure.

The piping 98*a* and, if provided, a silencer rack 98*b*, for the first boiler module $\mathbf{30}_1$ is provided on a piping deck 98, such as, for example, shown and further described with respect to FIG. 16. The piping deck 98 is assembled separately off site and then connected to the upper side of the first boiler module $\mathbf{30}_1$. The pipes have flanged ends to facilitate easy connection with the first boiler module $\mathbf{30}_1$.

In an embodiment, the piping deck 98 (including any railings) weighs from approximately 5,000 lb, or 5,500 lb, or 6,000 lb to 6,500 lb, or 6,750 lb or 7,000 lb. Any ladders required to gain access to the piping deck 98 are provided separately and weigh from approximately 25 lb, or 30 lb, or 40 lb, to 50 lb, or 60 lb, or 70 lb, or 75 lb.

In the embodiments, the silencer rack 98*b* weighs from approximately 4,000 lb, or 4,500 lb to 5,000 lb, or 5,500 lb, or 6,000 lb.

Low Pressure Boiler Module

In the embodiment shown in FIGS. 1B and 2-19, the second boiler module $\mathbf{30}_2$ is a low pressure boiler module, meaning that the operating pressure of the second boiler module $\mathbf{30}_2$ is less than the operating pressure of the previous (or, in this case, first) boiler module $\mathbf{30}_1$. The second boiler module $\mathbf{30}_2$ comprises the structure having integrated economizer and superheater functionality $\mathbf{30}c_1/\mathbf{30}a_2$, which is therefore shared between the first boiler module $\mathbf{30}_1$ and the subsequent boiler module $\mathbf{30}_2$, an evaporator $\mathbf{30}b_2$, and an economizer $\mathbf{30}c_2$. However, in other embodiments, the first boiler module 30, and second boiler module $\mathbf{30}_2$ do not share any components and the second boiler module $\mathbf{30}_2$ may include a separate superheater. The superheater $\mathbf{30}a_2$ (or, in the embodiment shown, the structure having integrated economizer and superheater functionality $\mathbf{30}c_1/\mathbf{30}a_2$) heats the steam exiting the boiler module $\mathbf{30}_1$ to the final temperature desired before entering the second boiler module $\mathbf{30}_2$.

Further, and as shown in FIG. 5, the second boiler module $\mathbf{30}_2$, and, if relevant, its individual components, includes flanged connections 43 for connecting the second boiler module $\mathbf{30}_2$ to other components of the mHRSG 100, as described above.

The superheater $\mathbf{30}a_2$ (or, in the embodiment shown, the structure having integrated economizer and superheater functionality $\mathbf{30}c_1/\mathbf{30}a_2$) may be connected to the other components of the mHRSG 100 by securing flanged ends to an expansion joint 25, such as shown, for example, in FIG. 7.

In the particular embodiment shown in FIG. 5, the second boiler module $\mathbf{30}_2$ further includes a plurality of water columns $\mathbf{32}_2$ (not shown), drum level instrumentation $\mathbf{34}_2$ (not shown), drum pressure instrumentation $\mathbf{36}_2$ (not shown) chemical feed drain rack with pre-piped instruments $\mathbf{37}_2$ (not shown) and a junction box with instruments pre-wired $\mathbf{38}_2$ (not shown). By pre-installing these components in the shop and prior to assembling the mHRSG on site, the mHRSG can be installed on site with little to no welding necessary.

In an embodiment, the evaporator $\mathbf{30}b_2$ is provided as a single unit including the water columns $\mathbf{32}_2$ (not shown), drum pressure instrumentation $\mathbf{36}_2$ (not shown), chemical feed drain rack with pre-piped instruments $\mathbf{37}_2$ (not shown), and junction box with pre-wired instruments $\mathbf{38}_2$ (not shown) preinstalled, and weighs from approximately 100, 000 lb, to 125,000 lb, or 130,000 lb to 140,000 lb, or 150,000 lb, or 155,000 lb.

In an embodiment, the economizer $\mathbf{30}c_2$ is secured to the downstream end of the evaporator $\mathbf{30}b_2$. A gasket is secured between the downstream flanges at the evaporator $\mathbf{30}b_2$ and upstream flanges of the economizer $\mathbf{30}c_2$, and the flanges are secured together using a plurality of bolt structures. In an embodiment, the bolt structures are bolts and used in combination with nuts and washers. In an embodiment, the gasket is a rope gasket. Insulation, such as durablanket insulation or insulated ductwork maybe secured to the joint between the evaporator $\mathbf{30}b_2$ and the economizer $\mathbf{30}c_2$ using retainer clips to improve the efficiency of boiler module $\mathbf{30}_2$.

Figure 17:
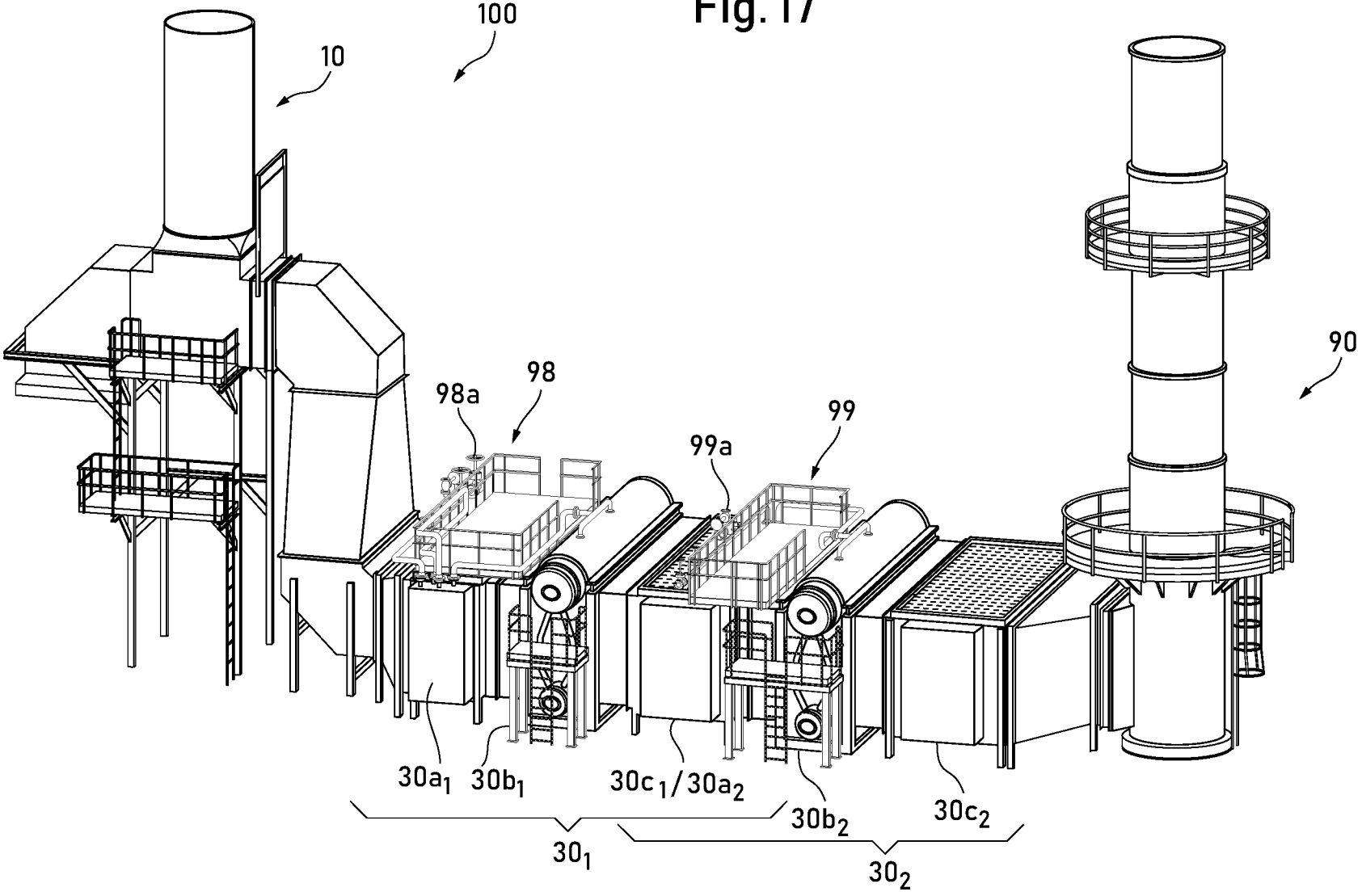
FIG. 17 shows the high pressure piping deck and low pressure piping deck of FIG. 16 connected to the mHRSG of FIG. 15 in accordance with embodiments of the present disclosure.
Figure 18:
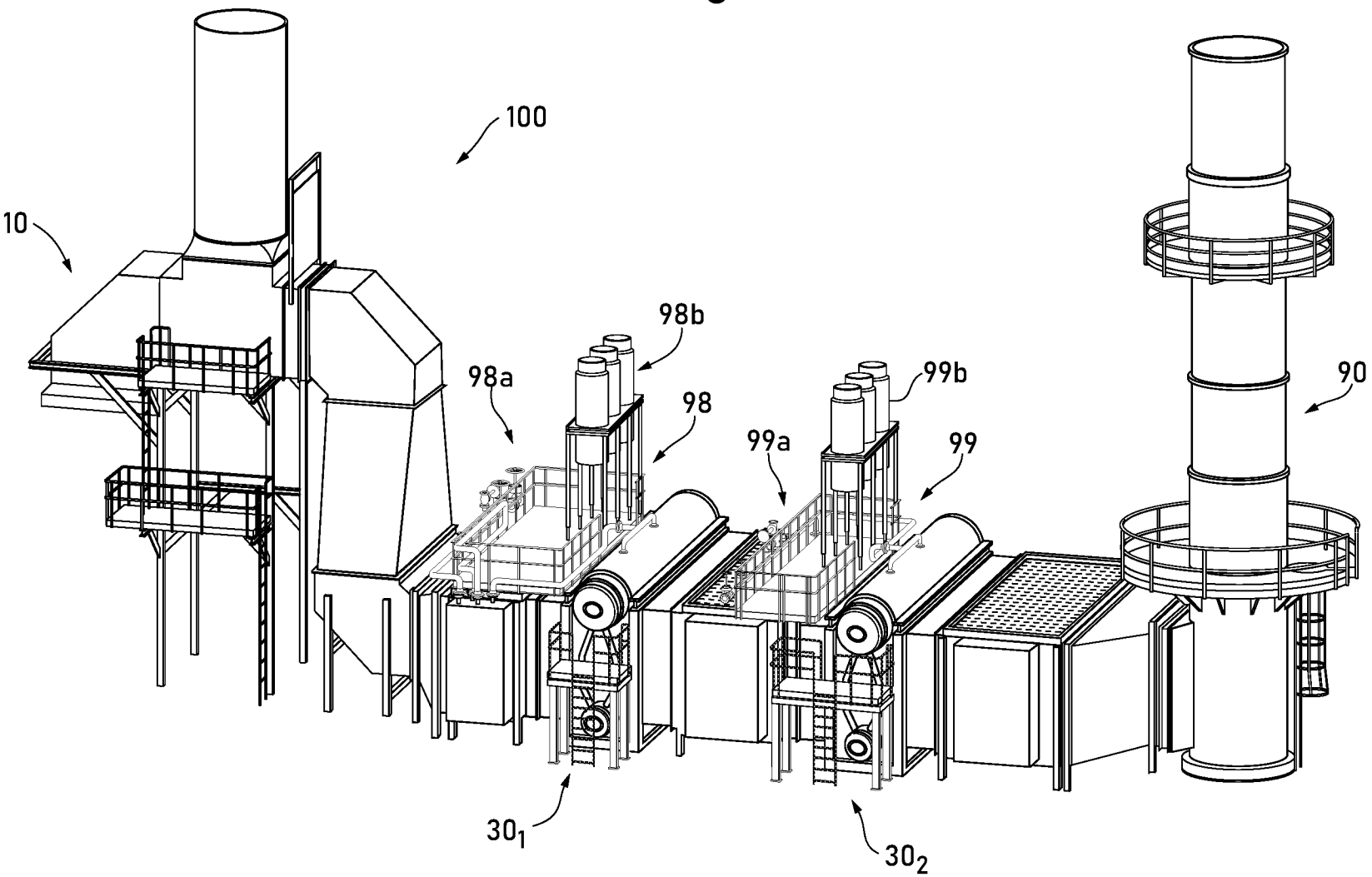
FIG. 18 shows a high pressure silencer rack and low pressure silencer rack connected to the mHRSG of FIG. 17 in accordance with embodiments of the present disclosure.

The piping 99*a* and, if provided, a silencer rack 99*b*, for the second boiler module $\mathbf{30}_2$ is provided on a piping deck 99, such as, for example, shown and further described with respect to FIGS. 16-18. The piping deck 99 is assembled separately off site and then connected to the upper side of the second boiler module $\mathbf{30}_2$. The pipes have flanged ends to facilitate easy connection with the second boiler module $\mathbf{30}_2$.

In an embodiment, the piping deck 99 (including any railings) weighs from approximately 5,000 lb, or 5,500 lb, or 6,000 lb to 6,500 lb, or 6,750 lb or 7,000 lb. Any ladders required to gain access to the piping deck 99 are provided separately and weigh from approximately 25 lb, or 30 lb, or 40 lb, to 50 lb, or 60 lb, or 70 lb, or 75 lb.

In the embodiments, the silencer rack 99*b* weighs from approximately 4,000 lb, or 4,500 lb to 5,000 lb, or 5,500 lb, or 6,000 lb.

The economizer $\mathbf{30}c_2$ is located at the downstream end of the second boiler module $\mathbf{30}_2$ before the main stack 90. The economizer $\mathbf{30}c_2$ heats any remaining condensate water traveling through the mHRSG 100 before reaching the main stack 90. While in the embodiments shown, the economizer $\mathbf{30}c_2$ is connected directly to the second boiler module $\mathbf{30}_2$ by securing the flange of the economizer $\mathbf{30}c_2$ to flanges of the second boiler module $\mathbf{30}_2$, in further embodiments, one or more expansion joints may be provided between the economizer $\mathbf{30}c_2$ and other components of the mHRSG 100. In an embodiment, the economizer $\mathbf{30}c_2$ includes from approximately 130, or 140 to 149, or 150, or 160, or 175 retainer clips and/or welds to secure to the evaporator $\mathbf{30}b_2$.

In an embodiment, such as shown in FIG. 7, the structure having integrated economizer and superheater functionality $\mathbf{30}c_1/\mathbf{30}a_2$ is operatively coupled to the evaporator $\mathbf{30}b_1$ and evaporator $\mathbf{30}b_2$. A gasket is secured between the downstream flanges of the evaporator $\mathbf{30}b_2$ and the upstream flanges of the structure $\mathbf{30}c_1/\mathbf{30}a_2$, and the flanges are secured together using a plurality of bolt structures. In an embodiment, the bolt structures are bolts used in combination with nuts and washers. In an embodiment, the gasket is a rope gasket. Insulation, such as durablanket insulation or insulated ductwork, may be secured to the joint between the evaporator $\mathbf{30}b_1$ and the structure $\mathbf{30}c_1/\mathbf{30}a_2$ using fastening structures, such as retainer clips. Similarly, to secure the structure having integrated economizer and superheater functionality $30c_1/30a_2$ to the evaporator $30b_2$, the flanges of the expansion join 25 are secured to the upstream flanges of the evaporator $30b_2$, using a plurality of bolt structures. In an embodiment, the bolt structures are bolts used in combination with nuts and washers. In an embodiment, the gasket is a rope gasket. A gasket may also be provided between the flanges and insulation secured to the joint. In an embodiment, the gasket is a rope gasket.

Main Stack

In an embodiment, the mHRSG includes a main stack 90, through which the steam exits the mHRSG 100. In an embodiment, such as shown in FIG. 11, the main stack 90 includes a stack damper 92 (not shown), a breeching 93 (not shown), a plurality of cable trays 93 (not shown), and a junction box 94 (not shown).

Figure 11:
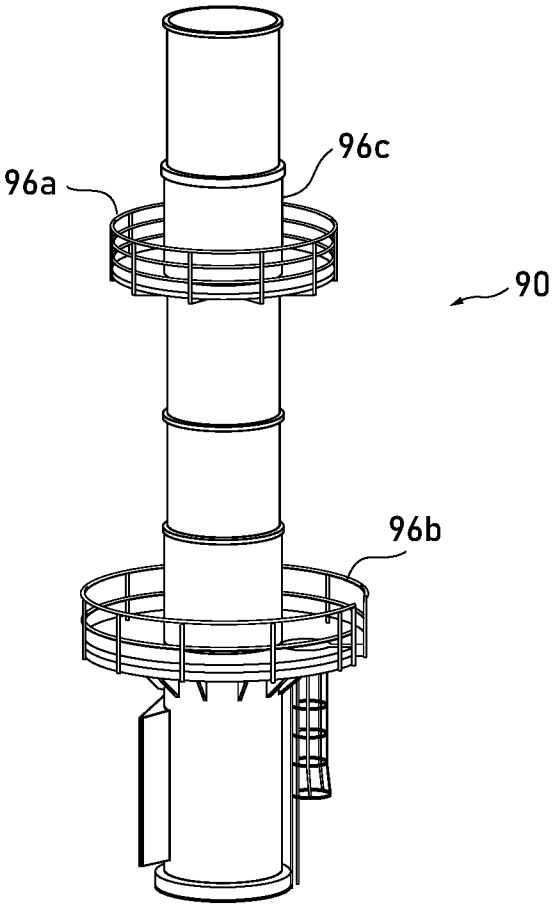
FIG. 11 is a main stack in accordance with embodiments of the present disclosure.

In the embodiment shown in FIG. 11, the main stack 90 is provided as a single unit weighing from approximately 28,000 lb, or 30,000 lb, or 30,500 lb to 30,700 lb, or 30,900 lb, 31,000 lb, or 33,000 lb.

Also shown in FIG. 11 are a number of platform components of the main stack 90 which may be optionally included depending on the specific configuration and size of the main stack 90. For example, shown in FIG. 11 are two stack platforms 96*a*, 96*b* and a plurality of lights 96*c* with a corresponding control box 96*d* (not shown).

In an embodiment, stack platforms 96*a*, 96*b* are each made from approximately 2, or 4 to 6 or 10 parts, such as beams, grid sheets, railings and brackets. Each platform 96*a*, 96*b* weighs from approximately 3,000 lb, or 3,250 lb, or 3,500 lb to 3,750 lb, or 4,000 lb, or 4,500 lb. Further components, such as lights, related control boxes, and other components deemed necessary by local regulatory authorities may be provided in multiple components and weigh, in aggregate, from approximately 50 lb, or 75 lb, or 100 lb, or 150 lb to 200 lb, or 250 lb, or 300 lb, or 400 lb.

Figure 12:
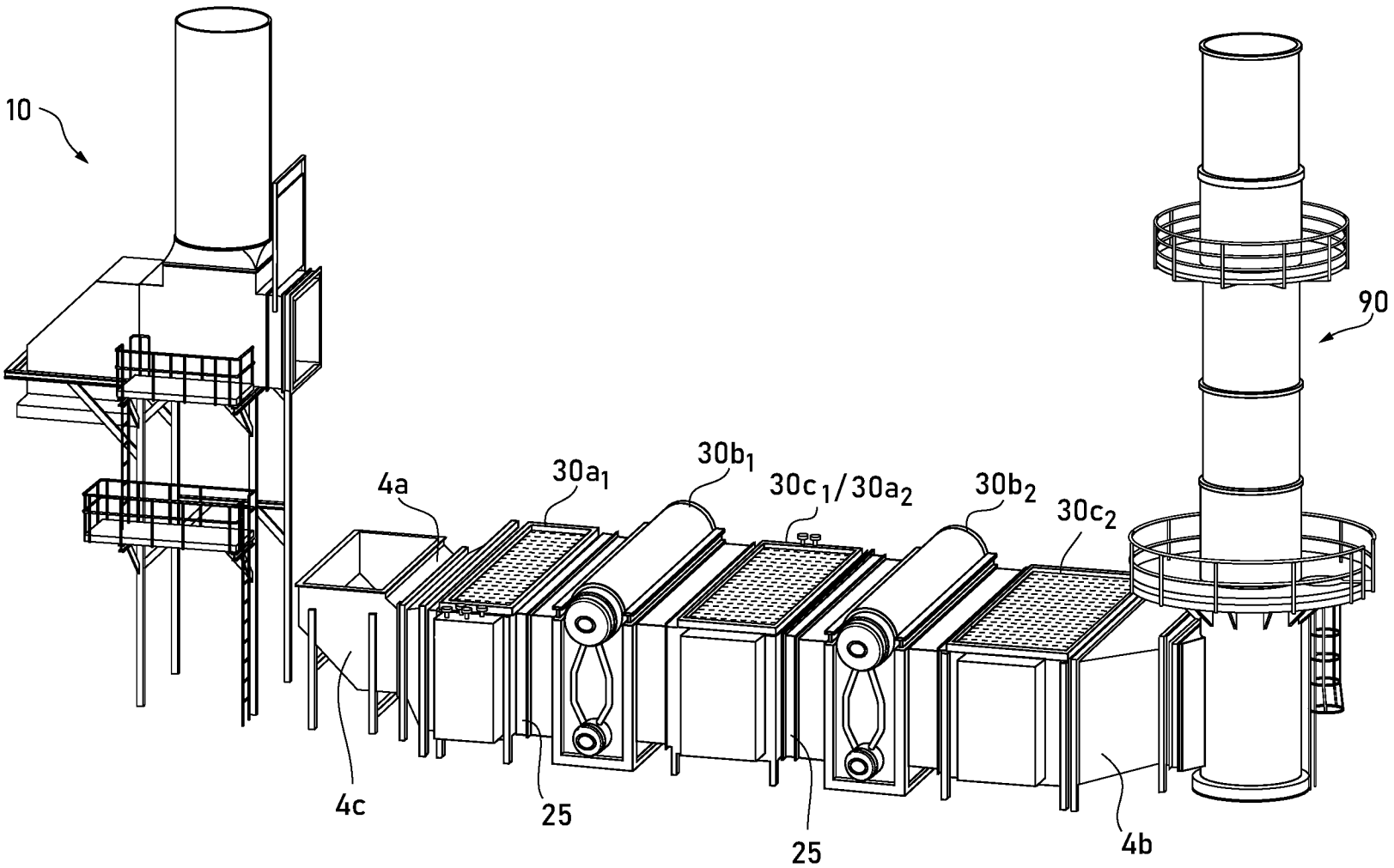
FIG. 12 illustrates the connection of the main stack of FIG. 11 to the mHRSG of FIG. 10 in accordance with embodiments of the present disclosure.

As shown in FIG. 12, the main stack 90 secures to transitional duct 4*b*, and particularly expansion joint 25 by way of flanges. A gasket is provided between downstream flanges on the expansion joint 25 and upstream flanges on the main stack 90. The flanges are secured together using a plurality of bolt structures. In an embodiment, the bolt structures are bolts used in combination with nuts and washers. In an embodiment, the gasket is a rope gasket.

Additional Ductwork and/or Transition Components

Figure 9:
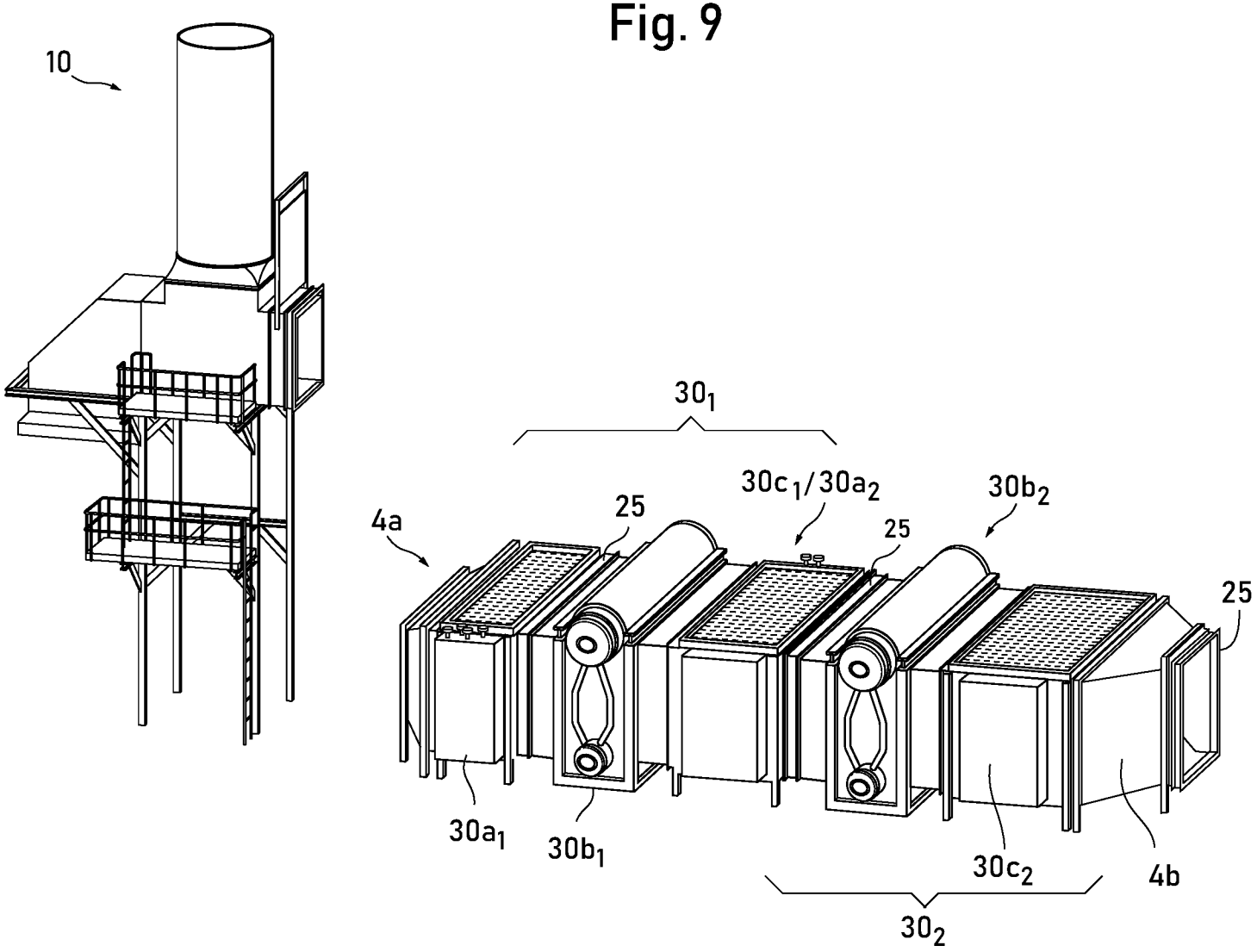
FIG. 9 illustrates additional ductwork used to connect the components of the mHRSG of FIG. 8 in accordance with embodiments of the present disclosure.

In an embodiment, the mHRSG 100 includes additional ductwork and/or transitional components to connect the individual components of the mHRSG 100. For example, as shown in FIGS. 1A, 1B and 9, transitional ducts 4*a*, 4*b* are provided as inlet and outlet transitions. In particular, transitional duct 4*a* provides an inlet for the first boiler module $30_1$ and transitional duct 4*b* provides an outlet from the economizer $30c_2$ to the main stack 90.

By way of further example, and as shown in FIGS. 10 and 12-14B, additional ductwork and/or transitional components, such as elbow connections 4*c* and vertical transitions 4*d*, may be needed to direct flue gas flow in different directions in order to properly flow through the mHRSG 100.

In an embodiment, transitional duct 4*a* is provided as a single unit having from approximately 130, or 140 to 147, or 150, or 160 retainer clips or welds to secure to the bypass system 10, superheater $30a_1$ and/or other ductwork. The inside liner dimensions of the transitional duct 4*a* are from approximately 9.00 ft, or 9.50 ft, or 10.00 ft to 10.08 ft, or 10.10 ft, or 10.30 ft, or 10.50 ft in height and from approximately 26.00 ft, or 26.20 ft, or 26.46 ft to 26.50 ft, or 26.75 ft, or 27.00 ft in width. In an embodiment, transitional duct 4*a* weighs from approximately 10,000 lb, or 10,500 lb, or 10,750 lb to 11.000 lb, or 11,250 lb, or 11,500 lb.

As shown in FIG. 9, the transitional duct 4*a* secures to the superheater $30a_1$ by way of flanges. A gasket is secured between downstream flanges on the transitional duct 4*a* and upstream flanges on the superheater $30a_1$. In an embodiment, the gasket is a rope gasket. The flanges are secured together using a plurality of bolt structures. In an embodiment, the bolt structures are bolts used in combination with nuts and washers. Insulation, such as durablanket insulation or insulated ductwork, may be provided at the joint between the transitional duct 4*a* and superheater $30a_1$ using, retainer clips, to improve the efficiency of boiler module $30_1$.

In an embodiment, transitional duct 4*b* is provided as a single unit having from 130, or 140 to 144, or 150, or 160 fastening components or structures, such as, by way of nonlimiting example, retainer clips and/or welds to secure to the economizer $30c_2$, main stack 90, and/or other ductwork. The inside linear dimensions of the transitional duct 4*b* are from approximately 10.00 ft, or 10.25 ft to 10.42 ft, or 10.60 ft, or 10.80 ft in height and from approximately 26.00 ft or 26.50 ft, or 26.75 ft to 26.79 ft, or 26.90 ft, or 27.25 ft in width. In an embodiment, transitional duct 4*b* weighs from 15,000 lb, or 15,500 lb to 16,000 lb, or 16,250 lb, or 16,500 lb. The transitional duct 4*b* may include integrated expansion joint 25.

As shown in FIG. 9, transitional duct 4*b* secures to economizer $30c_2$ by way of flanges. A gasket is secured between downstream flanges of the economizer $30c_2$ and upstream flanges of the transitional duct 4*b*. In an embodiment, the gasket is a rope gasket. The flanges are secured using a plurality of bolt structures. In an embodiment, the bolt structures are bolts used in combination with nuts and washers. Insulation, such as durablanket insulation or insulated ductwork may be provided at the joint between the economizer $30c_2$ and transitional duct 4*b* using fastening structures, such as retainer clips, to improve the efficiency of boiler module $30_2$.

In an embodiment, elbow connection 4*c* is provided as a single unit having from approximately 130, or 140 to 149, or 150, or 160 retainer clips or welds to secure to the bypass system 10, transitional duct 4*a*, or other ductwork. The inside linear dimensions of the elbow 4*c* are from approximately 10.00 ft, or 10.25 ft, or 10.42 ft to 10.50 ft, or 10.75 ft, or 11.00 ft in height and from approximately 26.00 ft, or 26.25 ft, or 26.50 ft to 26.79 ft, or 27.00 ft, or 27.50 ft in width. In an embodiment, elbow 4*c* weighs from approximately 26,000 lb, or 20,500 lb to 21,000 lb, or 21,250 lb, or 21,500 lb, or 21,750 lb.

Figure 10:
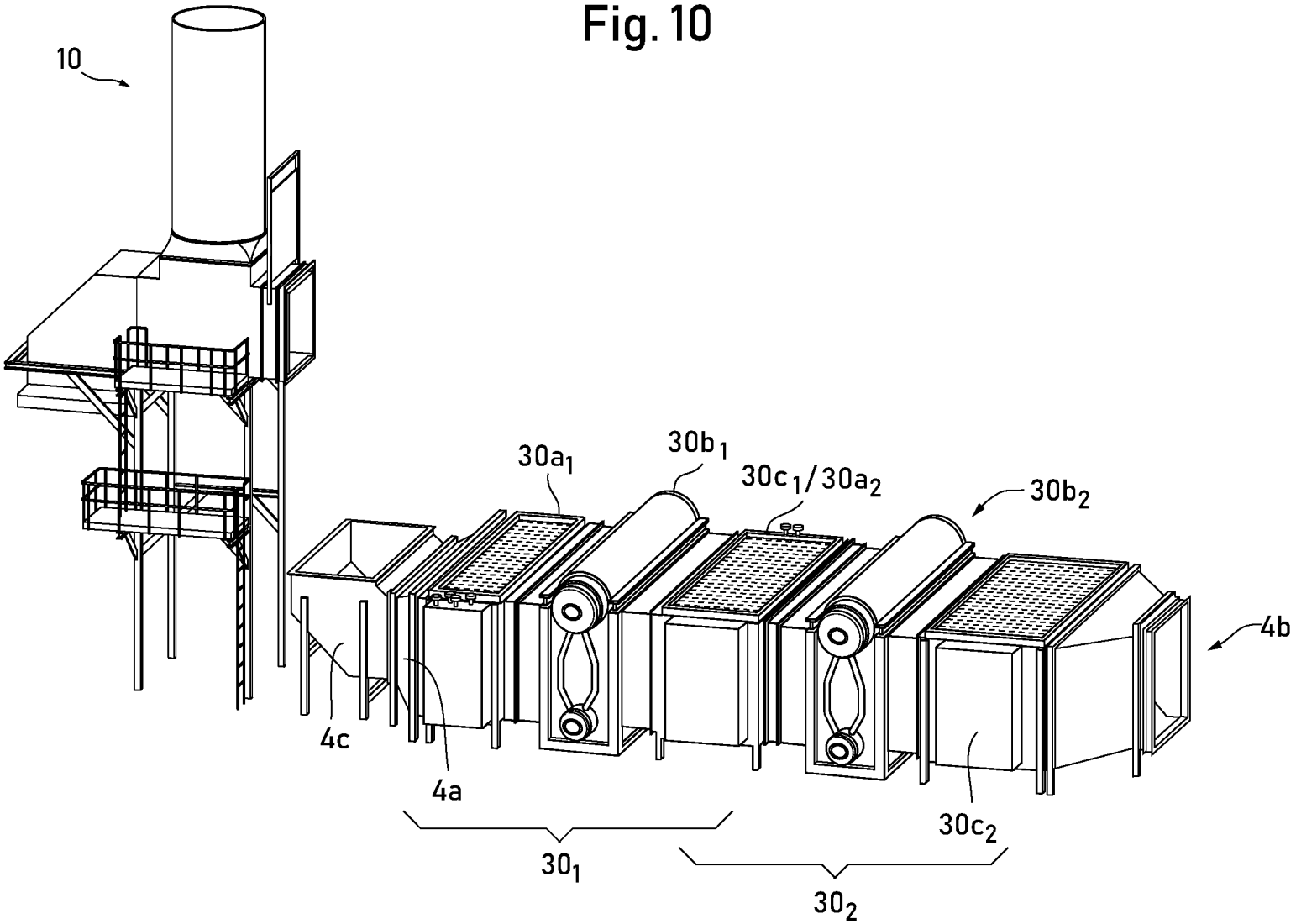
FIG. 10 illustrates additional ductwork used to connect the components of the mHRSG of FIG. 9 in accordance with embodiments of the present disclosure.

As shown in FIG. 10, the elbow connection 4*c* secures to transitional duct 4*a* by way of flanges. A gasket is secured between downstream flanges of the elbow 4*c* and upstream flanges of transitional duct 4*a*. In an embodiment, the gasket is a rope gasket. The flanges are secured together using a plurality of bolt structures. Insulation, such as durablanket insulation or insulated ductwork, may be provided at the joint between the elbow 4*c* and transitional duct 4*a* using fastening structures, such as retainer clips, to improve the efficiency of the mHRSG 100.

In an embodiment, vertical transition 4*d* is provided as two separate units: a vertical duct $4d_1$, and a diverter elbow $4d_2$. The vertical duct 4*d*, includes from approximately 40, or 45, or 50, to 55, or 58, or 60, or 70 fastening components or structures, such as, by way of nonlimiting example, retainer clips or welds, to secure the vertical duct $4d_1$, to the elbow $4d_2$, elbow 4*c* (see FIG. 14) or other ductwork. The inside linear dimensions of the vertical duct $4d_1$, are from approximately 6 ft, or 6.5 ft, or 7 ft, or 7.5 ft to 8 ft, or 8.5 ft, or 9 ft, in height and from approximately 5 ft, or 5.5 ft, or 6 ft to 6.5 ft, or 7 ft, or 7.5 ft or 8 ft in width. In an embodiment, the vertical duct $4d_1$ weighs from approximately 25,000 lb, or 27,000 lb to 28,000 lb, or 30,000 lb, or 32,000 lb.

In an embodiment, the elbow $4d_2$ weighs from approximately 16,000 lb, or 17,000 lb, or 18,000 lb to 18,500 lb, or 18,750 lb, or 19,000 lb.

Figure 13:
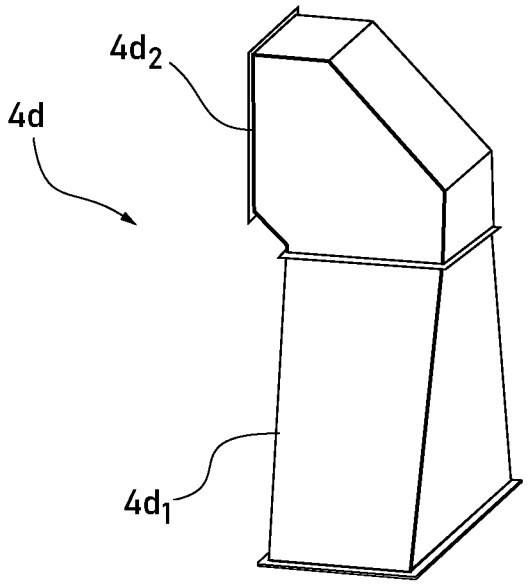
FIG. 13 illustrates additional ductwork used to connect the components of the mHRSG of FIG. 12 in accordance with embodiments of the present disclosure.

As shown in FIG. 13, the vertical duct $4d_1$, is secured to the elbow $4d_2$ by way of flanges. A gasket is provided between downstream flanges of the elbow $4d_2$ and upstream flanges of the vertical duct $4d_1$. In an embodiment, the gasket is a rope gasket. The flanges are secured together using a plurality of bolt structures. In an embodiment, the bolt structures are bolts used in combination with nuts and washers. Insulation, such as durablanket insulation or insulated ductwork, may be provided at the joint between the elbow $4d_2$ and vertical duct $4d_1$, using fastening structures, such as retainer clips.

In an embodiment, the assembled vertical transition 4*d* has inside linear dimensions (at the bottom) from approximately 8 ft, or 8.5 ft, or 9 ft to 9.5 ft, or 10 ft, or lift in height and from approximately 6.5 ft, or 7 ft, or 7.5 ft to 8 ft, or 9 ft in width, and weighs from approximately 44,500 lb, to 45,000 lb, or 45,500 lb to 46,000 lb, or 46,500 lb or 47,000 lb. In an embodiment, the vertical transition 4*d*, in aggregate, includes from approximately 50, or 55, or 60, or 65 to 66, or 70, or 75, or 80 fastening components or structures, such as, by way of nonlimiting example, retainer clips and/or welds.

Figure 14A:
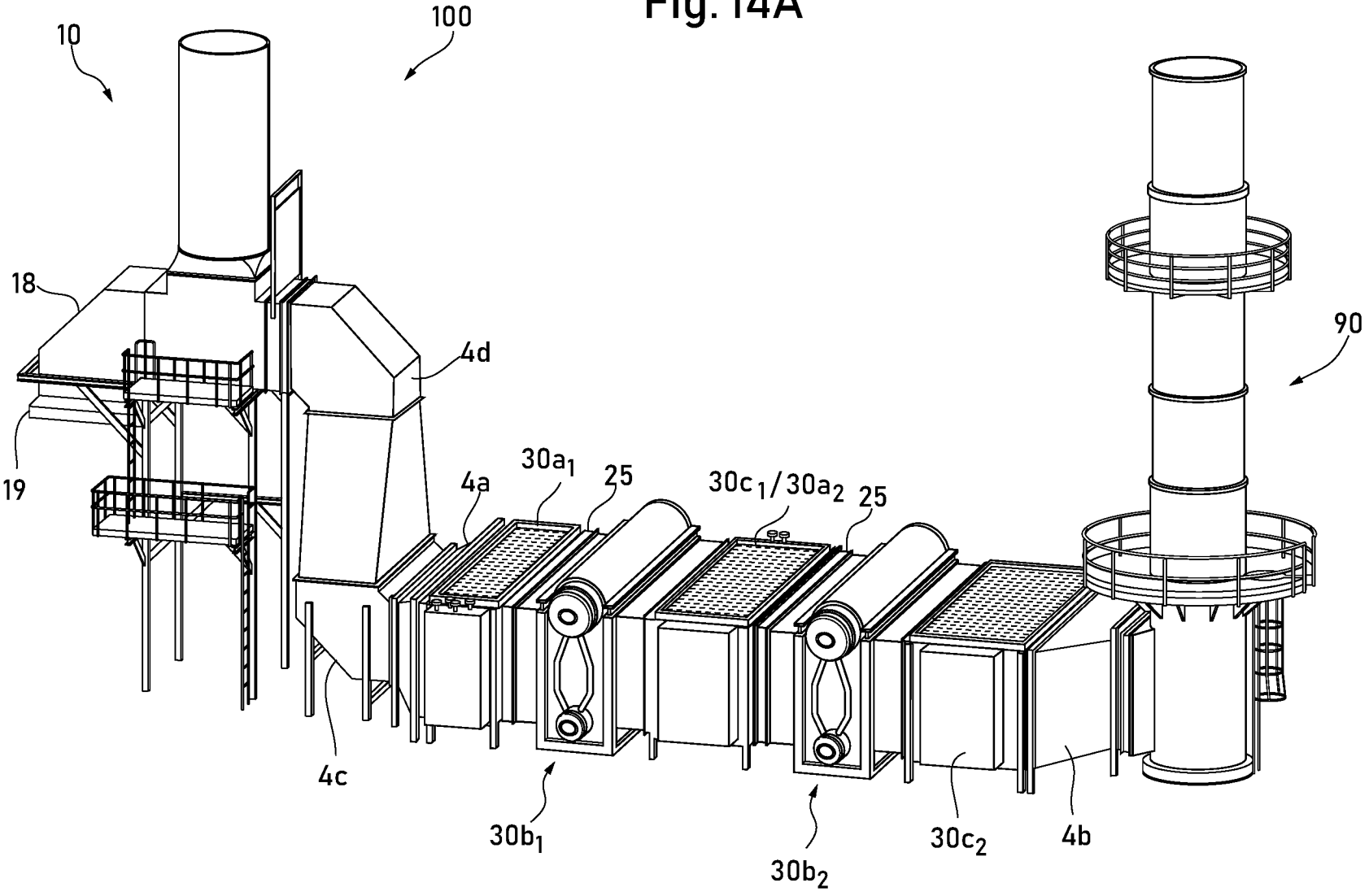
FIGS. 14A and 14B illustrate an assembled mHRSG following the addition of the ductwork of FIG. 13 in accordance with embodiments of the present disclosure.
Figure 14B:
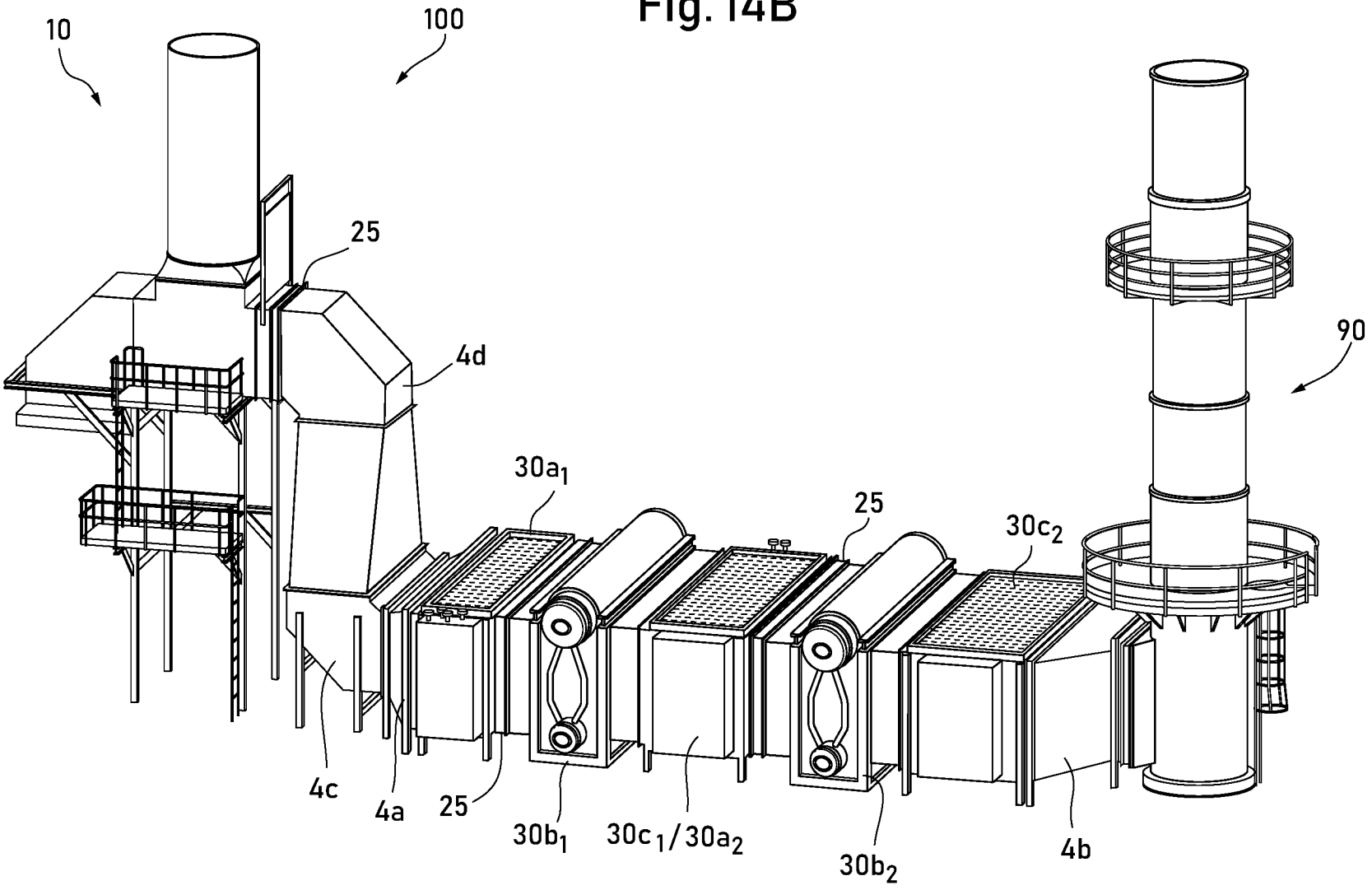

In an embodiment, as shown in FIG. 14B, the vertical duct 4*d* connects to the bypass system 10 and elbow 4*c* by way of flanges. For the connection to the bypass system, a gasket is provided between downstream flanges of the expansion joint 25 and upstream flanges of the vertical transition 4*d*. In an embodiment, the gasket is a rope gasket. The flanges are secured together using a plurality of bolt structures. In an embodiment, the bolt structures are bolts used in combination with nuts and washers.

For the connection between the vertical transition 4*d* and elbow 4*c*, a gasket is provided between downstream flanges of the vertical transition 4*d* and upstream flanges of the elbow. In an embodiment, the gasket is a rope gasket. The flanges are secured together using a plurality of bolt structures. In an embodiment, the bolt structures are bolts used in combination with nuts and washers. Insulation, such as durablanket insulation or insulated ductwork, may be provided at the joint between the vertical transition 4*d* and elbow 4*c* and secured using fastening structures, such as retainer clips.

Access Components

Figure 15:
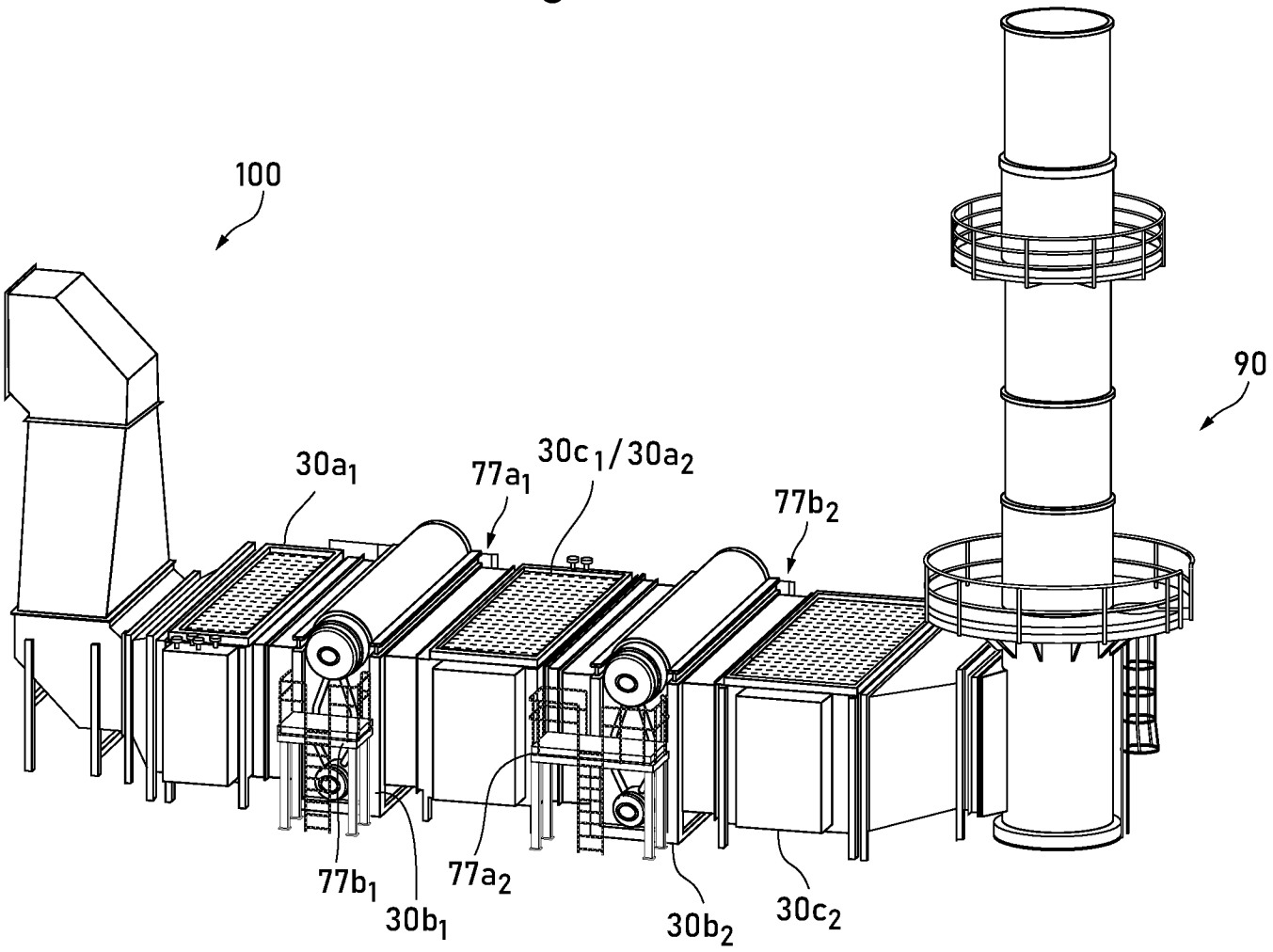
FIG. 15 shows access structures for a mHRSG in accordance with embodiments of the present disclosure.

In some embodiments, access components, including ladders, platforms, walkways, railings, gates or doors, and other such components may be provided to enhance access to the various components of the mHRSG 100, such as, for example, to perform maintenance, inspect or otherwise, get near to the components. For example, as shown in FIG. 15, the first boiler module $30_1$ and/or second boiler module $30_2$ may include access structures $77a_1$, $77a_2$, $77b_1$, $77b_2$. In the embodiment shown, the access structures include platforms, hand rails, and ladders; however, in further embodiments, additional components, such as stairways, etc., may be provided with an access structure.

In a particular embodiment, as shown in FIG. 15, structures $77a_1$ and $77a_2$ are superheater access structures and each provided as multiple components including one or more platforms, railings, support structures and/or ladders. In the embodiment shown, each access structure $77a_1$, $77a_2$ weighs (with integrated railings), from approximately 800 lb, 850 lb, or 900 lb to 950 lb, or 1,000 lb, or 1,500 lb. The structures for the access structures $77a_1$, $77a_2$ may be provided in from approximately 3, or 4 to 5, or 6, or 8 individual components, such as rails, beams, and/or brackets, and each weighs from approximately 1,500 lb, or 1,7500 lb, or 2,000 lb to 2,250 lb, or 2,500 lb, or 3,000 lb. Further, any ladders provided weigh from approximately 75 lb, or 80 lb, or 90 lb to 100 lb, or 110 lb, or 120 lb, or 125 lb.

Access structure $77a_1$, is secured to superheater $30a_1$ and access structure $77a_2$ is secured to the structure having integrated economizer and superheater functionality $30c_1$/$30a_2$. Evaporator access platforms $77b_1$ and $77b_2$, like superheater access platforms $77a_1$ and $77a_2$, are also provided as multiple components including one or more platforms, railings, support structures and/or ladders. In the embodiment shown, each access structure $77b_1$, $77b_2$, alone with integrated railings, weighs from approximately 600 lb, or 650 lb, or 700 lb to 750 lb, or 800 lb, or 850 lb. The support structures for access structures $77b_1$, $77b_2$ may be provided in from approximately 3, or 4 to 5, or 6, or 8 individual components, such as rails, beams, and/or brackets, and each weighs from approximately 1,000 lb, or 1,200 lb, or 1,250 lb to 1,500 lb, or 1,750 lb, or 2,000 lb.

Access structure $77b_1$ is secured to evaporator $30b_1$ and access structure $77b_2$ is secured to evaporator $30b_2$.

In an embodiment, the access platforms $77a_1$, $77a_2$, $77b_1$, $77b_2$ are secured to their respective components of the boiler modules using a plurality of bolt structures. In an embodiment, the bolt structures are bolts used in combination with nuts and washers.

Any ladders are likewise secured to their respective access structure, i.e., $77a_1$, $77a_2$, $77b_1$, $77b_2$, using a plurality of bolt structures. In an embodiment, the bolt structures are bolts used in combination with nuts and washers.

In the embodiments shown, the mHRSG 100 also includes two piping decks, a first piping deck 98 associated with the first boiler module $30_1$ and a second piping deck 99 associated with the second boiler module $30_2$, as shown in FIGS. 1A-1B and FIGS. 16-18 in particular. The piping decks 98, 99 are installed on top of the respective boiler modules $30_1$, $30_2$. The piping decks 98, 99 facilitate access to the upper structures and components of the respective boiler modules $30_1$, $30_2$.

In addition to providing access, the piping decks 98 and 99 serve as modular components to which the piping 98*a*, 99*a* (including valves and transitions) and silencer racks 98*b*, 99*b* can be secured. By securing the piping 98*a*, 99*a* and silencer racks 98*b*, 99*b* to the piping decks 98, 99, the piping decks 98, 99 can, in some embodiments, improve the modular efficiency of the mHRSG 100 by being able to configure and secure the piping 88*a*, 98*a* and/or silencer racks 98*b*, 99*b* prior to installation and assembly of the mHRSG 100 as a whole. Moreover, because the piping 98*a*, 99*a* (and, in some embodiments, portions of the silencer racks 98*b*, 99*b*) include flanges on their connecting portions, the piping decks 98, 99 can be put in place and the piping 98*a*, 99*a* connected to the piping of the first boiler module $30_1$ and second boiler module $30_2$, respectively, by securing the flanged connections using bolt structures. Welding can therefore be reduced or eliminated at the job site.

Additional Components

It will be appreciated that additional components will be necessary to provide a functioning mHRSG, and such additional components are readily apparent and understood to those skilled in the art as common in existing HRSGs. For example, each boiler module may require one or more steam outlets, further piping, pressure safety valves, pumps and other such components as known and used in the art.

Installation Sequence

FIG. 20 is a flowchart depicting a general installation sequence, or method of assembling a mHRSG as shown and described herein. In particular, the method 2000 includes providing a first boiler module (2100), providing a second boiler module (2200), operatively coupling the first boiler module and second boiler module using a plurality of bolt structures (2300), providing a main stack (2400), operatively coupling the main stack to the second boiler module using a plurality of bolt structures (2500), providing a first piping deck comprising a plurality of pipes and a second piping deck comprising a plurality of pipes (2600), operatively coupling the plurality of pipes of the first piping deck to the first boiler module using a plurality of bolt structures (2700) and operatively coupling the plurality of pipes of the second piping deck to the second boiler module using a plurality of bolt structures (2800). In an embodiment, the bolt structures are bolts.

In an embodiment, the plurality of pipes of the first piping deck has at least one pipe terminating in a flanged end and the first boiler module has a plurality of pipes having at least one pipe terminating in a flanged end. In such embodiment, the step of operatively coupling the plurality of pipes of the first piping deck to the first boiler module (2700) includes securing the flanged end of the at least one pipe terminating in a flanged end of the first boiler module to the flanged end of at least one pipe terminating in a flanged end of the first piping deck using a plurality of bolt structures. Likewise in an embodiment the plurality of pipes of the second piping deck has at least one pipe terminating in a flange and the second boiler module includes a plurality of pipes having at least one pipe that terminates in a flange. In such embodiment, the step of operatively coupling the pipes of the second piping platform to the second boiler module (2800) includes securing the flanged end of the at least one pipe terminating in a flanged end of the second piping deck to the flanged end of the at least one pipe terminating in a flanged end of the second boiler module using a plurality of bolt structures.

In an embodiment the first boiler made is a single structure comprising a superheater, evaporator and economizer and the second boiler module is a single structure comprising a superheater, evaporator, and economizer. In such embodiments, the steps of providing the first and second boiler modules (200, 2200) consists of providing the two structures. However, in further embodiments, the first and/or second boiler modules are one or more separate structures, for example, separate superheaters evaporators, and/or economizers. In such embodiments, the steps of providing the first and second boiler modules includes providing each of the separate structures. In a particular embodiment, the first boiler module includes a superheater, an evaporator, and a structure having integrated economizer/superheater functionality, and the second boiler module shares the structure having integrated economizer/superheater functionality and further includes an evaporator, and an economizer. In such embodiment the step of providing a first boiler module (2100) comprises providing a superheater, an evaporator, and a structure having integrated economizer/superheater functionality, and the step of providing the second boiler module (2200) comprises providing an evaporator and an economizer. Further, in such embodiments, the step of operatively coupling the first boiler module and second boiler module (2300) comprises operatively coupling, in sequence, the superheater, the evaporator of the first boiler module, the structure having integrated economizer/superheater functionality, the evaporator of the second boiler module, and the economizer.

FIGS. 2-19 describe a particular exemplary installation sequence for a mHRSG 100 as shown in FIG. 1B. It will be appreciated that the exemplary installation sequence shown in FIGS. 2-20 includes the optional components, e.g., bypass system, and the installation steps associated with such optional components may be omitted when such optional components are not used in a mHRSG. Further, although the installation sequence shown in FIGS. 2-19 shows a mHRSG having two boiler modules, one of skill in the art will readily appreciate the repetition or deletion of steps and other modifications needed to install a mHRSG having alternate numbers of boiler modules.

Turning to FIG. 2, a bypass support structure 11 is first provided. In an embodiment, the bypass support structure 11 is provided pre-assembled. In a further embodiment, the bypass support structure 11 is at least partially assembled on site. A bypass support structure 11 may be in accordance with any embodiment or combination of embodiments disclosed herein.

Turning to FIG. 3, a diverter system 15 with bypass stack 12 is then provided. In an embodiment, the diverter system 15 and bypass stack 12 are provided pre-assembled. In a further embodiment, the diverter system 15 and bypass stack 12 are at least partially assembled on site.

Turning to FIG. 4, the diverter system 15 with bypass stack 12 are next secured to the bypass support structure 11. In embodiments, the securing is accomplished by way of a plurality of bolt structures. Additional duct work, such as the diverter inlet duct 18, and other components, such as expansion joints like inlet transition expansion joint 19, may be attached to the bypass system 10 at this time. In further embodiments, such additional duct work and/or transitional components and/or expansion joints may be added at such time as needed.

Further, in some embodiments, access structures, such as the platforms 11*b* and 11*c* are secured to the bypass support structure 11.

Turning to FIG. 5, a first boiler module $\mathbf{30}_1$ is provided. A first boiler module $\mathbf{30}_1$ is in accordance with any embodiment or combination of embodiments disclosed herein. In particular, the evaporator $\mathbf{30}b_1$ of the first boiler module is provided.

Figure 6:
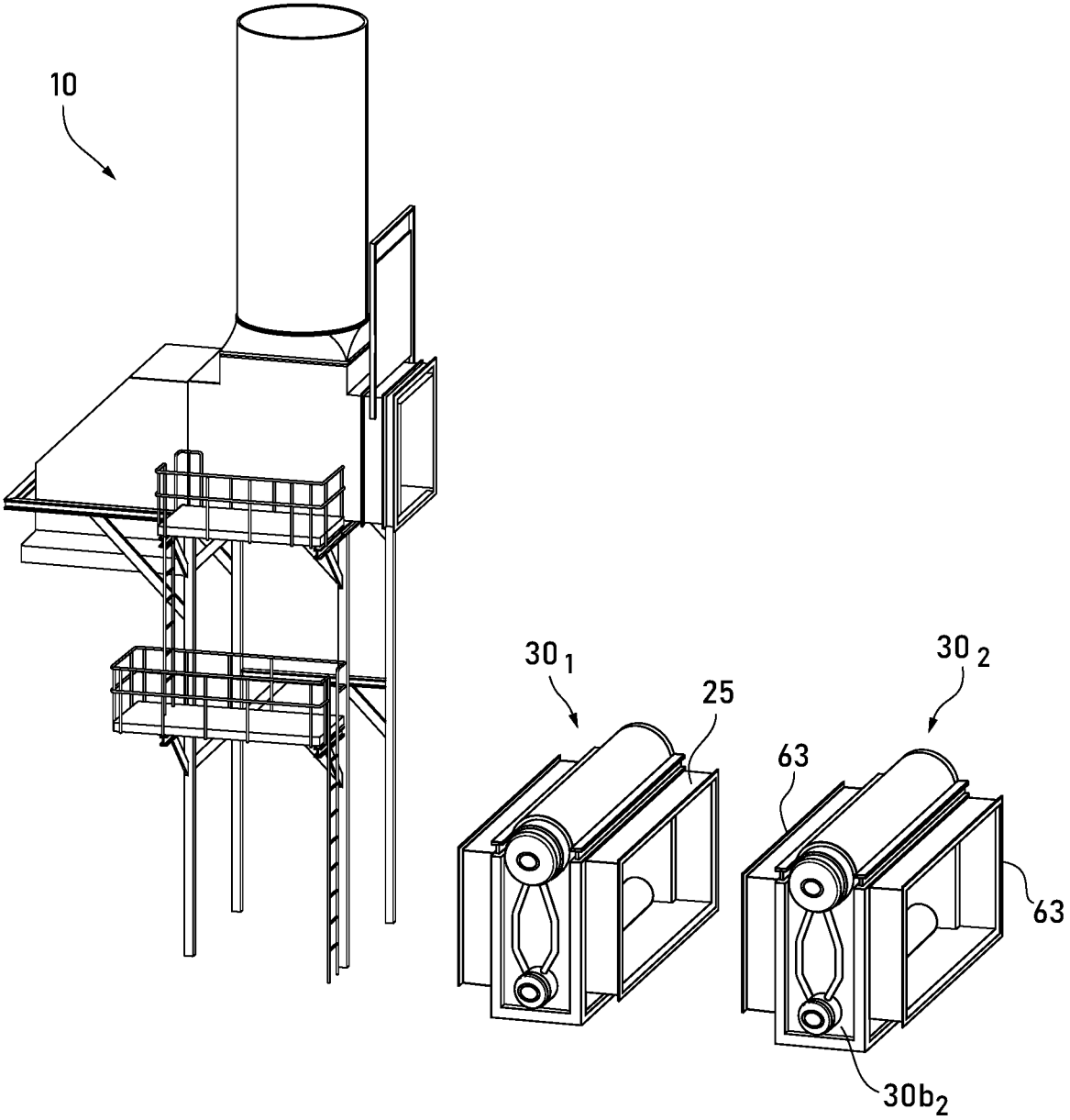
FIG. 6 is an exemplary low pressure boiler module in accordance with embodiments of the present disclosure.

Turning to FIG. 6, a second boiler module $\mathbf{30}_2$ is provided. A second boiler module $\mathbf{30}_2$ is in accordance with any embodiment or combination of embodiments disclosed herein. In particular, the evaporator $\mathbf{30}b_2$ of the second boiler module is provided.

Turning to FIG. 7, a structure having both economizer and superheater functionality $\mathbf{30}c_1/\mathbf{30}a_2$ is provided and secured between the evaporator $\mathbf{30}b_1$ and the evaporator $\mathbf{30}b_2$.

In an embodiment, an expansion joint 25 is secured between the structure having both high pressure economizer and low pressure superheater functionality $\mathbf{30}c_1/\mathbf{30}a_2$ and one or both of the evaporator $\mathbf{30}b_1$, $\mathbf{30}b_2$.

In an embodiment, the securing of the structure having both high pressure economizer and low pressure superheater functionality $\mathbf{30}c_1/\mathbf{30}a_2$ to the evaporator $\mathbf{30}b_1$, $\mathbf{30}b_2$, or any interfering structure such as expansion joint 25, is accomplished using a plurality of bolt structures.

Figure 8:
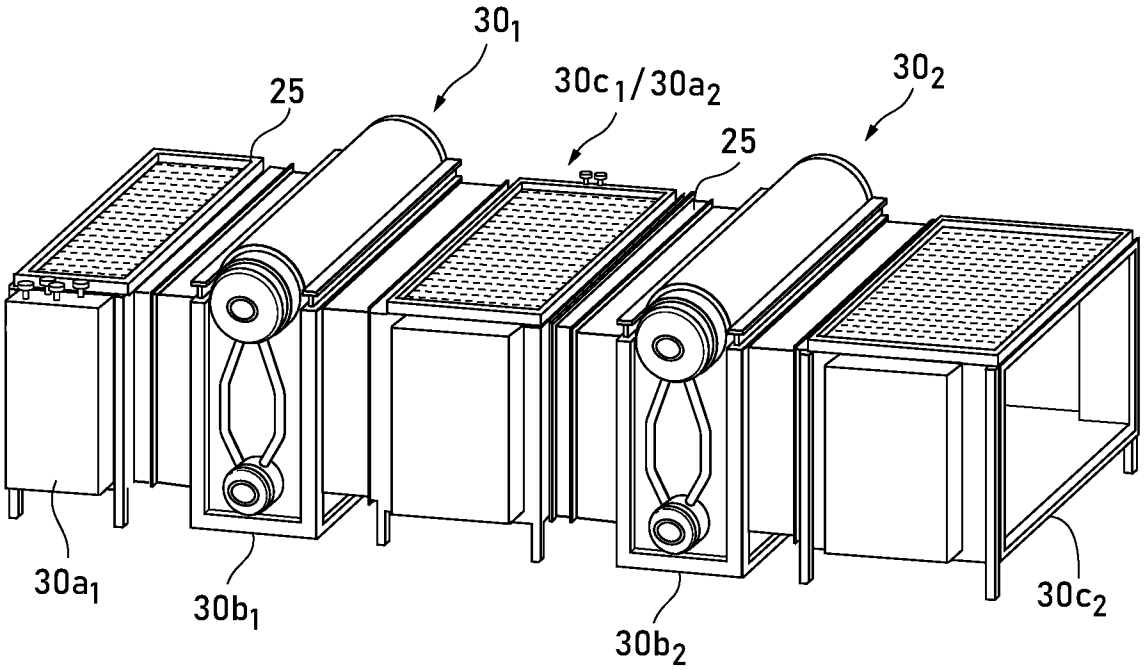
FIG. 8 shows a high pressure superheater and low temperature economizer connected to the mHRSG of FIG. 7 in accordance with embodiments of the present disclosure.

Turning to FIG. 8, a superheater $\mathbf{30}a_1$ and economizer $\mathbf{30}c_2$ are provided. The superheater $\mathbf{30}a_1$ is secured to the evaporator $30b_1$. The economizer $30c_2$ is secured to the evaporator $30b_2$. In some embodiments, another component such as additional ductwork and/or an expansion joint, may be provided between the superheater $30a_1$ and evaporator $30b_1$, such as expansion joint 25 shown in FIG. 8, and/or between the evaporator $30b_2$ and the economizer $30c_2$.

In an embodiment, the securing of the superheater $30a_1$ to the evaporator $30b_1$, or, in the case of the embodiment shown in FIG. 8, the securing of the expansion joint 25 between the superheater $30a_1$ and the evaporator $30b_1$, is accomplished using a plurality of bolt structures.

Turning to FIG. 9, the next step is the providing of additional ductwork, such as the transition ducts 4*a* and 4*b*. The transition ductwork 4*a*, 4*b* are secured to the superheater $30a_1$ and economizer $30c_2$, respectively, using a plurality of bolt structures.

Turning to FIG. 10, a superheater inlet duct elbow 4*c* is provided and secured to the inlet duct 4*a* to being the upward transition to the bypass system 10 components. The securing is accomplished using a plurality of bolt structures. Moreover, as described in additional detail above with respect to other components, one or more expansion joints may be provided between ductwork elements if needed or desired.

Turning to FIG. 11, a main stack 90 is provided. A main stack 90 may be in accordance with any embodiment or combination of embodiments provided herein.

Turning to FIG. 12, the main stack 90 is secured to the economizer $30c_2$ via the transition ductwork 4*b* and, in some embodiments, an expansion joint. The securing is accomplished by securing the flanges of the connection portion of the main stack 90 to the flanges of the transition ductwork 4*b*, or, if an expansion joint is used, to the flanges of the expansion joint, using a plurality of bolt structures.

Turning to FIG. 13, vertical transition ductwork 4*d* is provided. As shown in FIGS. 14A-14B, the vertical transition ductwork 4*d* connects the superheater $30a_1$ and corresponding inlet ductwork, e.g., transition 4*a* and elbow 4*c* to the bypass system 10. The ductwork 4*d* is connected to the bypass system 10 and elbow 4*c* using a plurality of bolt structures.

Turning to FIG. 15, access structures 77*a* and 77*b* are provided and secured to the first boiler module 30, and second boiler module $30_2$, respectively. In other embodiments, additional access structures may be provided and secured to specific components of the first and/or second boiler modules $30_1$, and $30_2$, such as, for example, to the superheater $30a_1$, structure having both high pressure economizer and low pressure superheater functionality $30a_1/30a_2$ and/or the economizer $30c_2$. In an embodiment, the securing is accomplished with a plurality of bolt structures.

Turning to FIG. 16, a first piping deck 98 and a second piping deck 99 are provided, each with the piping 98*a*, 99*a*, respectively, already arranged on and secured to the respective deck 98, 99. As shown in FIG. 17, the first piping deck 98 is secured to the upper side of the first boiler module $30_1$ and, in some embodiments, and particularly as shown in FIG. 17, on the upper surface of the superheater $30a_1$. As further shown in FIG. 17, the second piping deck 99 is secured to the upper side of the second boiler module 30*a* and, in some embodiments, and particularly as shown in FIG. 17, on the upper surface of the structure having both high pressure economizer and low pressure superheater functionality $30a_1/30a_2$. Depending on the configuration of the first boiler module $30_1$ and the second boiler module $30_2$, the first and second piping decks 98, 99, respectively, may be partially secured (as shown in FIG. 17) or entirely secured to the upper surface of the superheater $30a_1$ and structure having both high pressure economizer and low pressure superheater functionality $30c_1/30a_2$, respectively.

After the first piping deck 98 and second piping deck 99 are secured to the upper surface of the mHRSG 100, the piping 98*a*, 99*a* is connected to the piping of the first boiler module $30_1$ and second boiler module $30_2$, respectively. The securing of the respective piping is completed by using a plurality of bolt structures to tighten the flanges of the piping 98*a*, 99*b* to the flanges of the piping of the first boiler module $30_1$ and second boiler module $30_2$, respectively.

Turning to FIG. 18, a first deck silencer rack 98*b* and a second deck silencer rack 99*b* are provided and secured to their respective piping decks 98, 99. In further embodiments, the respective pressure silencer racks may be secured to another access structure, such as a superheater access structure or evaporator access structure. Again, any necessary piping is connected by way of flanges and bolt structures.

Figure 19:
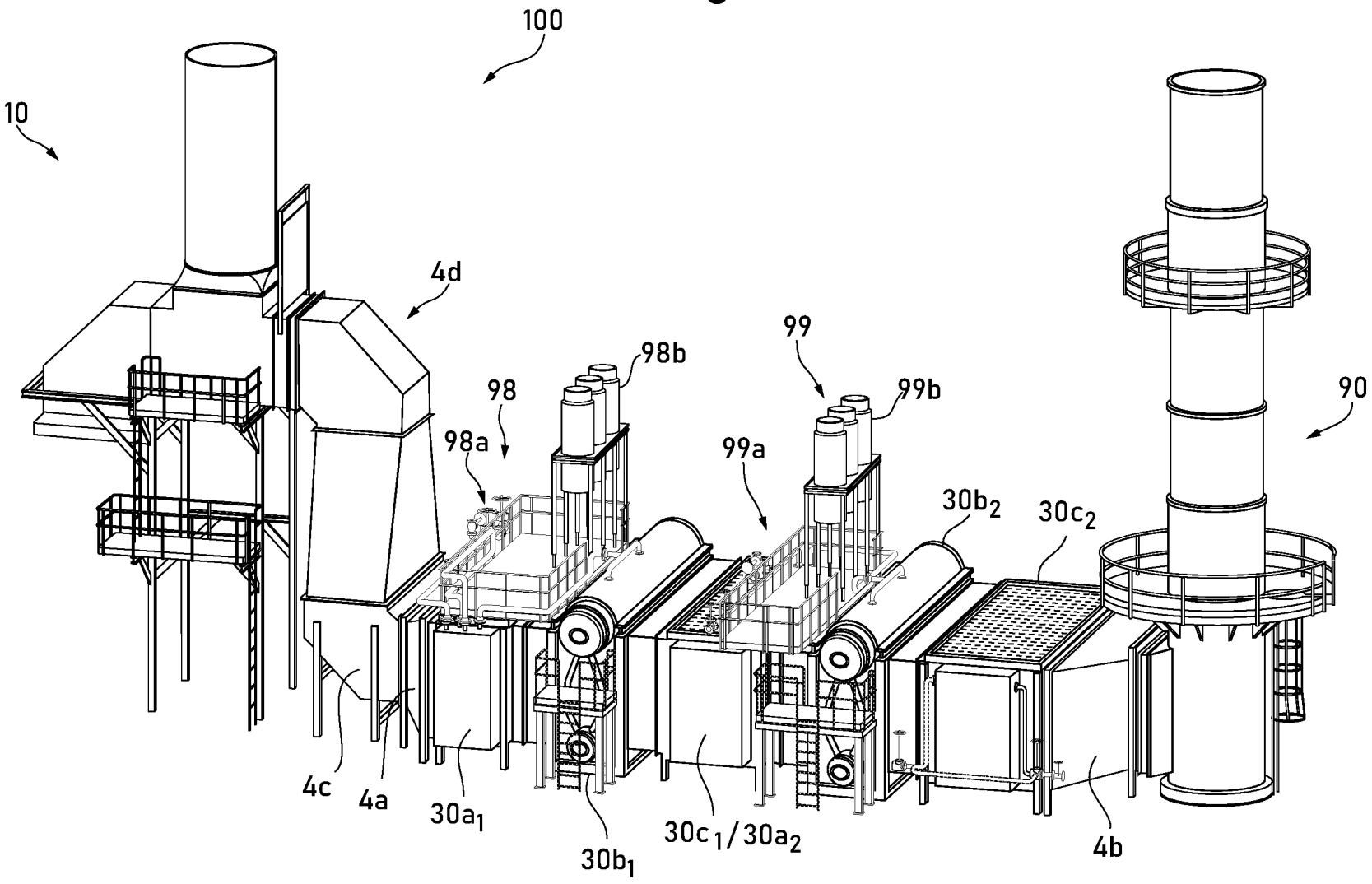
FIG. 19 is an exemplary embodiment of a mHRSG in accordance with embodiments of the present disclosure.

FIG. 19 illustrates the completed mHRSG 100 resulting from the installation sequence illustrated in FIGS. 2-18, and as further generally described with reference to FIG. 20.

Some embodiments of the present disclosure will now be referred to.

E1. In an embodiment, the present disclosure provides a modular heat recovery steam generator (mHRSG) comprising a first boiler module comprising a plurality of pipes having at least one pipe terminating in a flanged end; a first piping deck comprising a plurality of pipes having at least one pipe terminating in a flanged end, wherein the pipe terminating in a flanged end of the first piping deck is secured to the pipe terminating in a flanged end of the first boiler module using a plurality of bolt structures extending through the flanged ends; a second boiler module comprising a plurality of pipes having at least one pipe terminating in a flanged end; a second piping deck comprising a plurality of pipes having at least one pipe terminating in a flanged end, wherein the pipe terminating in a flanged end of the second piping deck is secured to the pipe terminating in a flanged end of the second boiler module using a plurality of bolt structures extending through the flanged ends; and a main stack, wherein the first boiler module is operatively coupled to the second boiler module, and wherein the second boiler module is operatively coupled to the main stack.

E2. The mHRSG of E1, wherein the first boiler module comprises a superheater, an evaporator, and a structure having integrated economizer/superheater functionality.

E3. The mHRSG of E1, wherein the first piping deck comprises a silencer rack.

E4. The mHRSG of E2, wherein the second boiler module comprises the structure having integrated economizer/superheater functionality, an evaporator, and an economizer.

E5. The mHRSG of E1, wherein the second boiler module comprises a silencer rack.

E6. The mHRSG of E4, wherein the structure having integrated economizer/superheater functionality is operatively coupled to the evaporator of the first boiler module and evaporator of the second boiler module.

E7. The mHRSG of E1 further comprising a bypass system.

E8. The mHRSG of E1, wherein the bolt structures are bolts.

E9. In an embodiment, the present disclosure provides a method of assembling a modular heat recovery steam generator (mHRSG), comprising the steps of: providing a first boiler module; providing a second boiler module; operatively coupling the first boiler module and the second boiler module using a plurality of bolts, retainer clips, or combinations thereof; providing a main stack; operatively coupling the main stack to the second boiler module using a plurality of bolts, retainer clips, or combinations thereof; providing a first piping deck comprising a plurality of pipes and a second piping deck comprising a plurality of pipes; operatively coupling the plurality of pipes of the first piping deck to the first boiler module using a plurality of bolts; and operatively coupling the plurality of pipes of the second piping deck to the second boiler module using a plurality of bolts.

E10. The method of E9, wherein the plurality of pipes of the first piping deck has at least one pipe terminating in a flanged end and the first boiler module comprises a plurality of pipes having at least one pipe terminating in a flanged end, wherein the step of operatively coupling the pipes of the first piping deck to the first boiler module comprises: securing the flanged end of the at least one pipe terminating in a flanged end of the first piping deck to the flanged end of the at least one pipe terminating in a flanged end of the first boiler module.

E11. The method of E9, wherein the plurality of pipes of the second piping deck has at least one pipe terminating in a flanged end and the second boiler module comprises a plurality of pipes having at least one pipe terminating in a flanged end, wherein the step of operatively coupling the pipes of the second piping deck to the second boiler module comprises: securing the flanged end of the at least one pipe terminating in a flanged end of the second piping deck to the flanged end of the at least one pipe terminating in a flanged end of the second boiler module.

E12. The method of E9 wherein the first boiler module comprises a superheater, an evaporator, and a structure having integrated economizer/superheater functionality; and the step of operatively connecting the first and second boiler modules includes operatively connecting the superheater to the evaporator and the evaporator to the structure having integrated economizer/superheater functionality using a plurality of bolt structures.

E12. The method of E12, wherein the second boiler module comprises the structure having integrated economizer/superheater functionality, an evaporator and an economizer, and the step of operatively coupling the first and second boiler modules includes operatively connecting the structure having integrated economizer/superheater functionality to the economizer of the second boiler module, and the economizer of the second boiler module to the economizer.

E14. The method of E13, wherein the step of operatively connecting the main stack to the second boiler module comprises operatively connecting the main stack to economizer.

E15. The method of E9, further comprising the steps of providing a bypass system; and operatively coupling the bypass system to the first boiler module.

The benefits of the designs disclosed herein include, but are not limited to, the following: The design allows for flexible manufacturing because the pressure parts and piping decks are modularized. Assembly JIGs ensure that the parts fit correctly together. Logistical benefits include that the modules are shipped in installed orientation, thereby eliminating tailing cranes, and include factory-mounted instrumentation and valves. This design is erection-ready, i.e. there is a reduced flue gas height for minimal scaffolding, no welded pressure parts, and a presence of bolted module connects. Welded module connections are available without changes to the design.

Notwithstanding the above description, it should be appreciated that the present disclosure is intended to encompass numerous other systems, arrangements, and operational processes in addition to those descripted above. In reference to the preceding paragraphs and the aforementioned figures, although various embodiments of the present invention have been described above, it should be understood that embodiments have been presented by way of example, and not limitation. A person of ordinary skill in the art will recognize that there are various changes that can be made to the present invention without departing from the spirit and scope of the present invention. Therefore, the invention should not be limited by any of the above-described example embodiments, but should be defined only in accordance with the following claims and equivalents of the claimed invention presented herein.

The invention claimed is:

1. A modular heat recovery steam generator (mHRSG) comprising:

a first boiler module comprising a plurality of pipes having at least one pipe terminating in a flanged end;

a first piping deck, the first piping deck being a modular component comprising a plurality of pipes having at least one pipe terminating in a flanged end, wherein the pipe terminating in a flanged end of the first piping deck is secured to the pipe terminating in a flanged end of the first boiler module using a plurality of bolt structures extending through the flanged ends;

a second boiler module comprising a plurality of pipes having at least one pipe terminating in a flanged end;

a second piping deck, the second piping deck being a modular component comprising a plurality of pipes having at least one pipe terminating in a flanged end, wherein the pipe terminating in a flanged end of the second piping deck is secured to the pipe terminating in a flanged end of the second boiler module using a plurality of bolt structures extending through the flanged ends; and a main stack, wherein the first piping deck is connected to an upper side of the first boiler module, the first boiler module is operatively coupled to the second boiler module, and the second boiler module is operatively coupled to the main stack.

2. The mHRSG of claim 1, wherein the first boiler module comprises a superheater, an evaporator, and an economizer.

3. The mHRSG of claim 1, wherein the second boiler module comprises a superheater, an evaporator, and an economizer.

4. The mHRSG of claim 1, wherein an integrated structure comprising an economizer and a superheater is operatively coupled to an evaporator of the first boiler module and an evaporator of the second boiler module.

5. The mHRSG of claim 1, wherein the bolt structures are bolts.

6. The mHRSG of claim 1, wherein the second piping deck is connected to an upper side of the second boiler module.

7. A method of assembling a modular heat recovery steam generator (mHRSG), comprising the steps of:

providing a first boiler module, the first boiler module comprising a plurality of pipes having at least one pipe terminating in a flanged end;

providing a second boiler module;

operatively coupling the first boiler module and the second boiler module;

providing a main stack, operatively coupling the main stack to the second boiler module using a plurality of bolt structures;

providing a first piping deck, the first piping deck being a modular component comprising a plurality of pipes, the plurality of pipes of the first piping deck has at least one pipe terminating in a flanged end, and a second piping deck, the second piping deck being a modular component comprising a plurality of pipes;

securing the first piping deck to an upper side of the first boiler module;

operatively coupling the plurality of pipes of the first piping deck to the first boiler module by securing the flanged end of the at least one pipe terminating in a flanged end of the first piping deck to the flanged end of the at least one pipe terminating in a flanged end of the first boiler module using a plurality of bolt structures; and operatively coupling the plurality of pipes of the second piping deck to the second boiler module using a plurality of bolt structures.

8. The method of claim 7, wherein the plurality of pipes of the second piping deck has at least one pipe terminating in a flanged end and the second boiler module comprises a plurality of pipes having at least one pipe terminating in a flanged end, wherein the step of operatively coupling the plurality of pipes of the second piping deck to the second boiler module comprises:

securing the flanged end of the at least one pipe terminating in a flanged end of the second piping deck to the flanged end of the at least one pipe terminating in a flanged end of the second boiler module.

9. The method of claim 7 wherein the first boiler module comprises a superheater, an evaporator, and an integrated structure comprising an economizer and a superheater; and the step of operatively connecting the first and second boiler modules includes operatively connecting the superheater to the evaporator and the evaporator to the integrated structure comprising an economizer and a superheater using a plurality of bolt structures.

10. The method of claim 9, wherein the second boiler module comprises the integrated structure comprising an economizer and a superheater, an evaporator and an economizer, and the step of operatively coupling the first and second boiler modules includes operatively connecting the integrated structure comprising an economizer and a superheater to the economizer of the second boiler module, and the economizer of the second boiler module to the economizer.

11. The method of claim 10, wherein the step of operatively coupling the main stack to the second boiler module comprises operatively connecting the main stack to economizer.

12. The method of claim 7, further comprising a step of: securing the second piping deck to an upper side of the second boiler module.

* * * * *